United States Patent [19]

Bateson

[11] Patent Number: 4,948,300

[45] Date of Patent: Aug. 14, 1990

[54] MULTIPLE SECTION PIER AND INSTALLATION ASSEMBLY

[75] Inventor: Norman E. Bateson, Culver, Ind.

[73] Assignee: Norson Industries, Inc., Culver, Ind.

[21] Appl. No.: 194,452

[22] Filed: May 16, 1988

[51] Int. Cl.[5] ..... E02B 3/20

[52] U.S. Cl. ..... 405/220; 405/221

[58] Field of Search ..... 405/218, 219, 220, 221; 114/263, 266, 267

[56] References Cited

U.S. PATENT DOCUMENTS

| | | | |
|---|---|---|---|
| 3,074,239 | 1/1963 | Mustard | 405/221 |
| 3,421,327 | 1/1969 | Donaldson | 405/220 |
| 3,686,876 | 8/1972 | Muschell | 405/220 |
| 4,126,006 | 11/1978 | Lewis | 405/220 |
| 4,398,849 | 8/1983 | Morgan et al. | 405/221 |
| 4,645,380 | 2/1987 | Hambrick et al. | 405/220 |

*Primary Examiner*—David H. Corbin

*Attorney, Agent, or Firm*—Lockwood, Alex, FitzGibbon & Cummings

[57] ABSTRACT

A novel multiple pier section and installation assembly includes a plurality of modular pier sections, a dolly for transporting, installing and removing the individual pier sections, and a dolly locator. The pier sections have a hinged pier section interconnection system which utilizes a dual pin/slot arrangement that resists both lateral and longitudinal as well as verticla movement of the installed pier. Adjustable pier legs which can be raised or lowered from atop the pier to accommodate variations in water depth are mounted to one end of each modular pier section. The dolly includes a chassis and a pivotally mounted pier section support unit, a dolly hold down system and a pier section hold down system. The dolly and dolly locator cooperate to assure proper alignment and positioning of the dolly during installation and removal of the pier sections.

70 Claims, 14 Drawing Sheets

122
151
149
125
126
135
133
133a
154
139
152
148
147
101b
153
148a
160
159
155
156
157
158
7.
8.
141
101
137
145
143
142
144
146
102
150b
150a

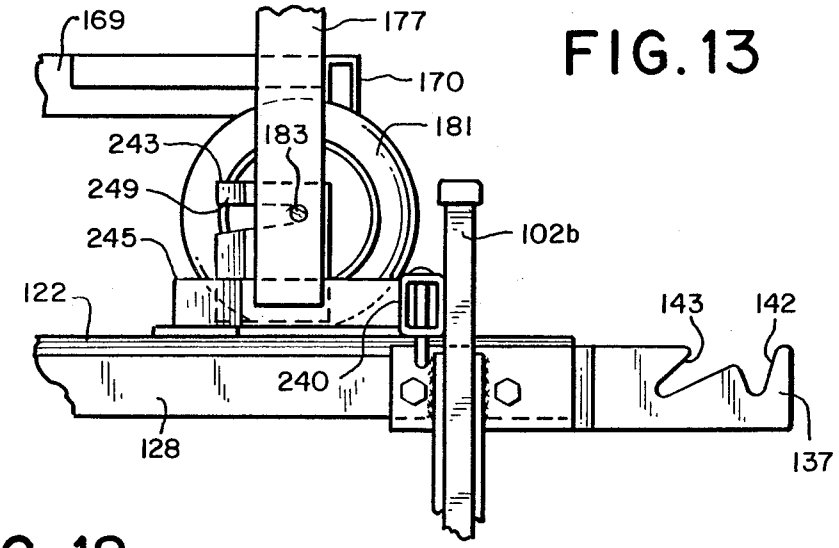
FIG. 13
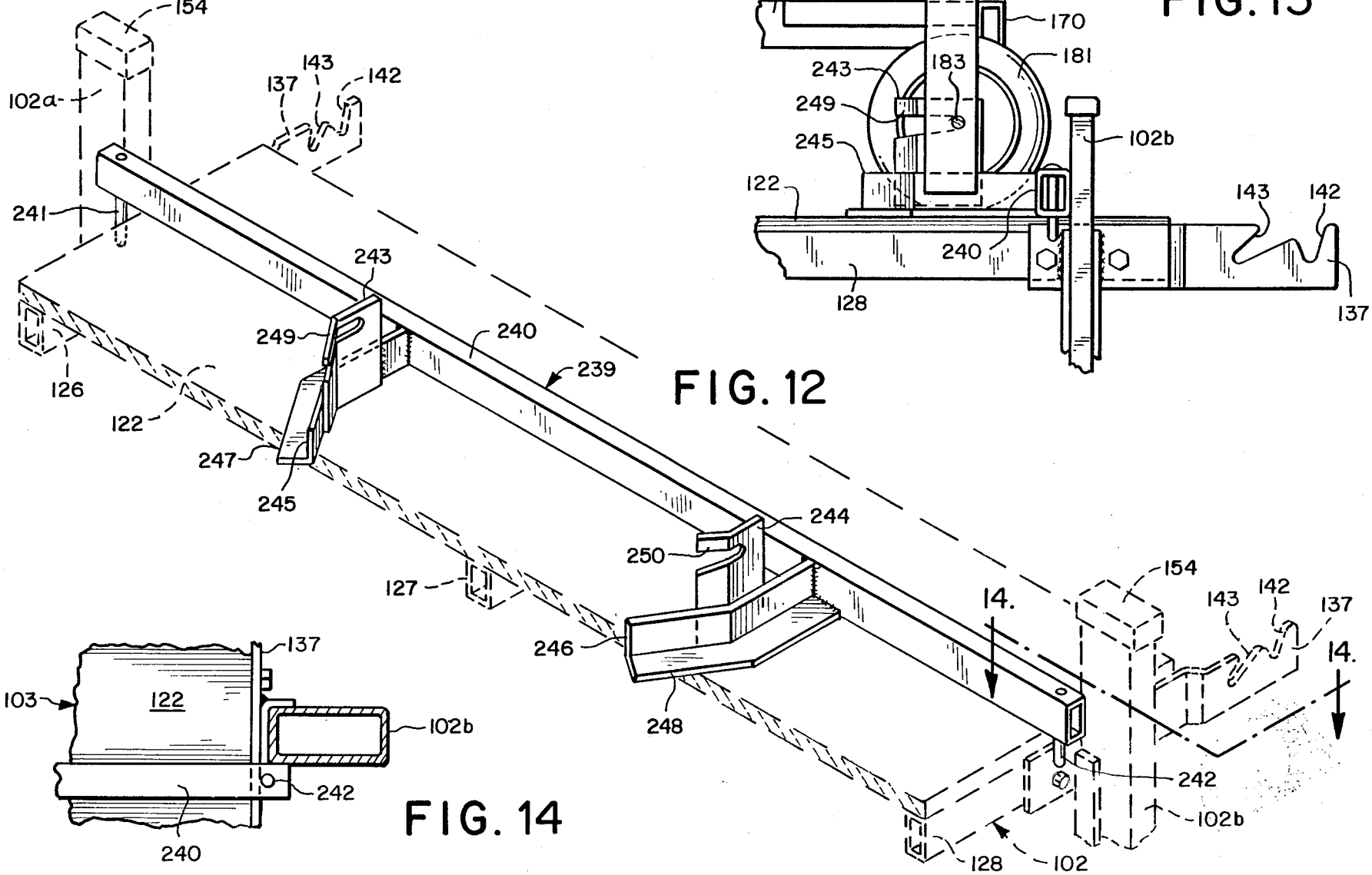
FIG. 12
FIG. 14

FIG. 21
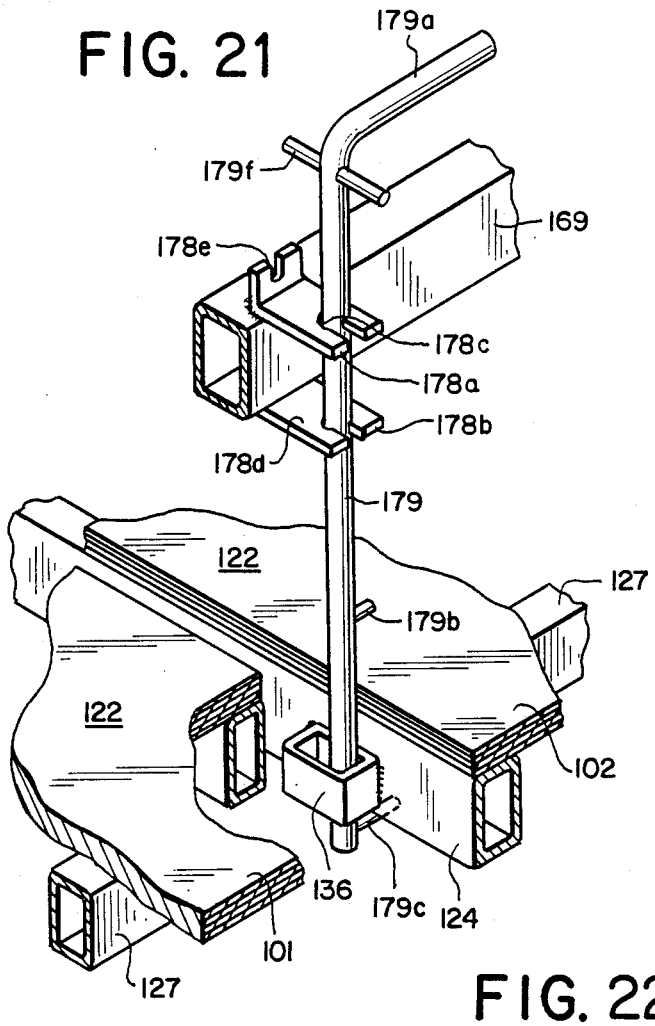
FIG. 22
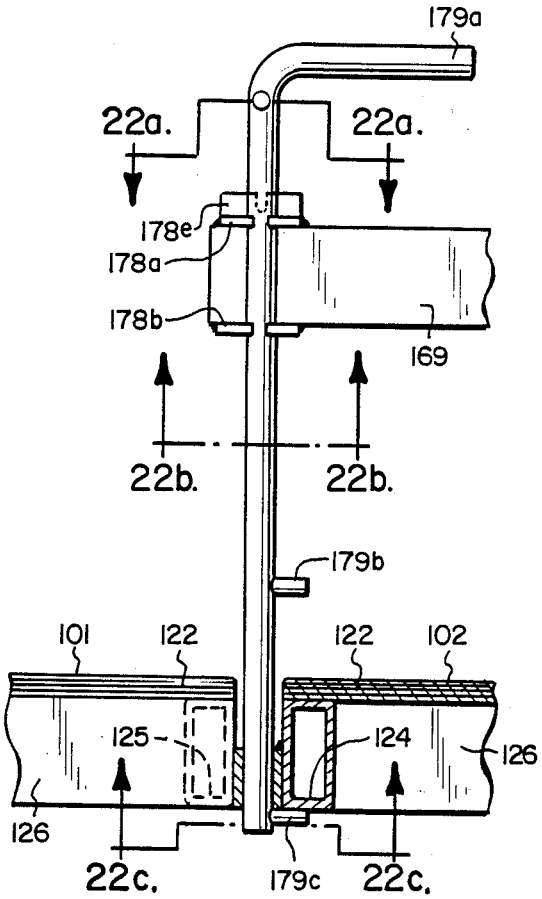
FIG. 22a
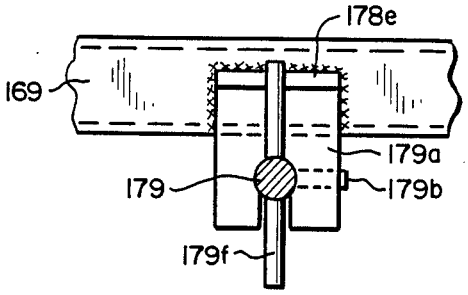
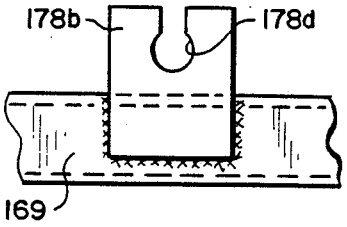
FIG. 22b
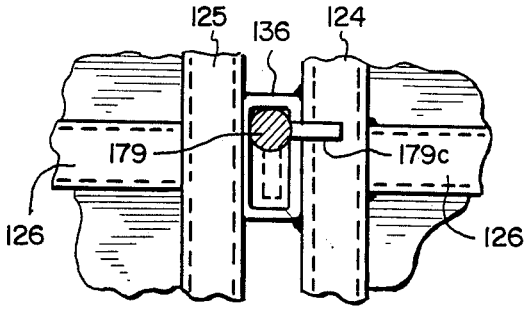
FIG. 22c FIG. 26
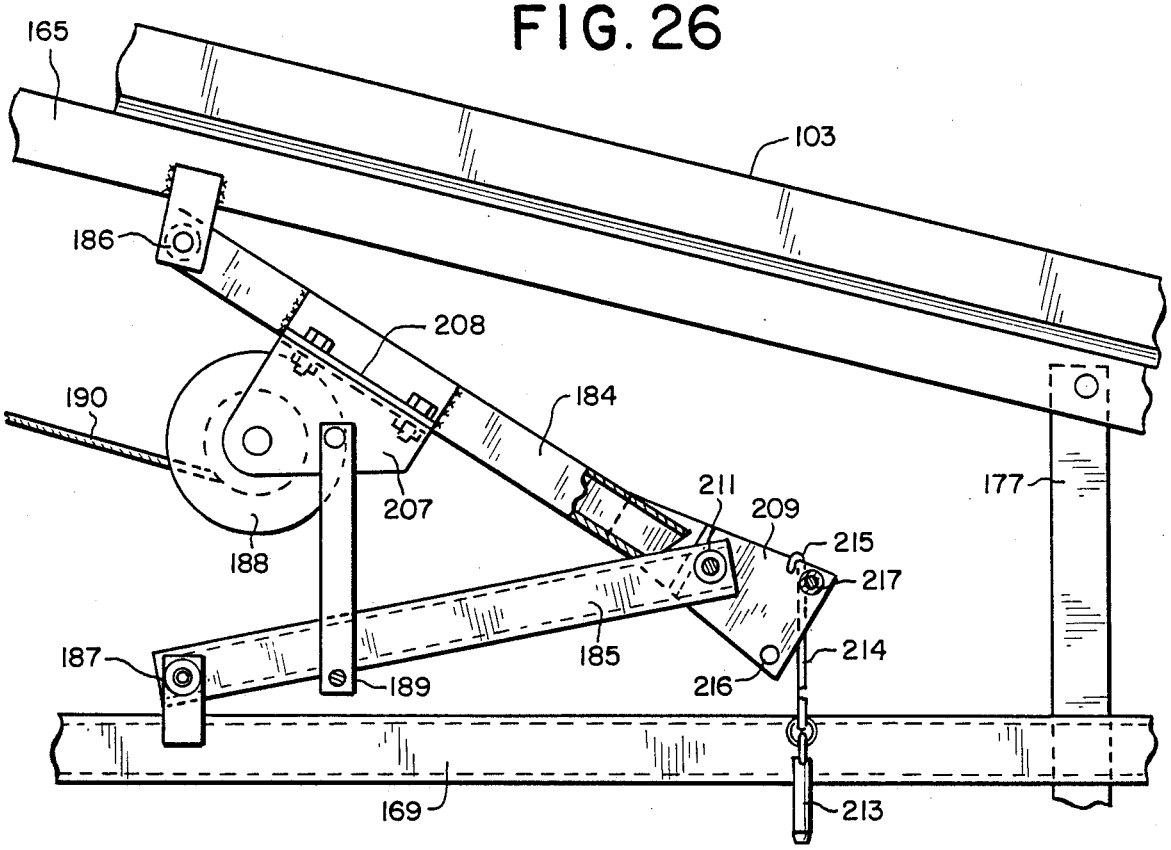
FIG. 27
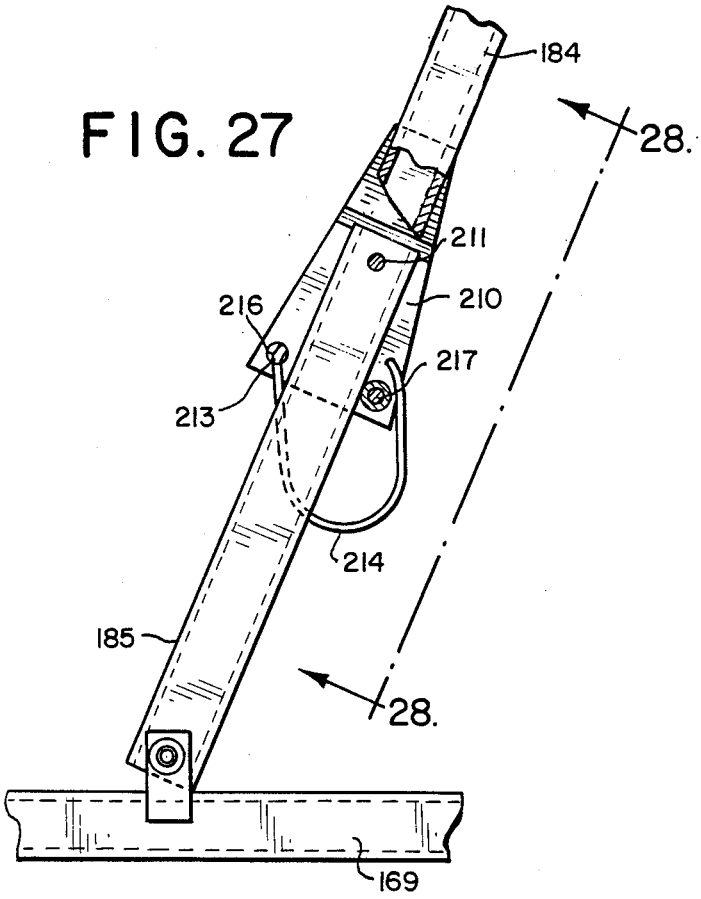
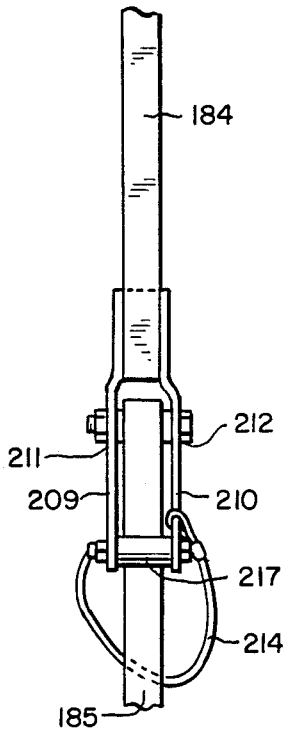
FIG. 28

MULTIPLE SECTION PIER AND INSTALLATION ASSEMBLY

BACKGROUND AND DESCRIPTION OF THE INVENTION

The present invention generally relates to a multiple section pier and installation assembly and, more particularly, to a novel pier as well as a dolly and dolly locator which cooperate with components of the pier to facilitate pier installation and removal. In this regard, an important aspect of the present invention is directed to a pier and installation system wherein a plurality of modular pier sections can be assembled into virtually any desired pier layout which system utilizes a novel dolly for both transporting and installing the individual modular pier sections. A unique dolly locator functions in association with the pier sections and the dolly to assure accurate positioning of the dolly to enable one-person installation and removal of the individual modular pier sections without requiring entry into the water by such person.

Piers employed in lakes subject to freezing are commonly installed in the spring and removed in the fall due to the destructive effects of harsh weather conditions, particularly the combined effect of wind and ice. Failure to remove a pier from a lake prior to the advent of such harsh weather conditions can result in the severe pier damage.

Installation and removal of piers has in the past been a tedious process requiring more than one person. Traditionally, for example, a series of posts are driven into the lake bed to support the pier and a plurality of individual horizontal planks then secured to those posts. These piers are generally incapable of assembly from one end of an existing or previously assembled pier section and, moreover, require entry into the water both during installation and disassembly.

U.S. Pat. No. 4,645,380 describes a docking system which includes a number of dock sections each of which is provided with a pair of legs at one end thereof that engage the bottom of a lake or body of water. The end of each of these dock sections opposite from the leg end thereof is engaged with a preceding dock section by a locking system which includes fixed, closed U-shaped retainers at the sidewalls adjacent the leg end of the previously installed dock section and hooks at the sidewalls adjacent the end of the dock section to be installed in juxtaposition thereto.

The system described in the '380 patent is characterized by a number of serious drawbacks including the need to use at least two people during the installation and/or removal. Alignment or matching of the respective U-shaped retainers and hooks during installation is also difficult. Furthermore, the individual deck sections are difficult to adjust in order to compensate for changes in water depth or unstable lake bottoms. Additionally, when installed, the interconnections between adjacent dock sections are not stable with respect to both the vertical and horizontal forces to which these piers are commonly subjected.

The present invention overcomes the problems and disadvantages of these prior pier and dock systems by providing a novel multiple section pier and installation assembly which features, among other things, a plurality of novel modular pier sections having a unique hinged pier section interconnection system which includes a dual pin/slot arrangement that resists lateral and longitudinal as well as vertical movement of the installed pier. Additionally, adjustable pier legs can be easily raised or lowered from atop the pier to accommodate variations in water depth. In this regard, another aspect of the present invention concerns a novel dolly and dolly locator which facilitate installation and removal of the individual modular pier sections. This dolly enables both the transporting and installation of the individual pier sections by one person, without requiring that person to enter the water.

It is, therefore, a general object of the present invention to provide a new and improved pier.

Another object of the present invention is to provide a new and improved pier installation assembly.

Another object of this invention is to provide a novel pier an installation assembly wherein the pier can be installed, adjusted or removed by one person without requiring that person to enter the water.

Another object of the present invention is to provide a new and improved multiple section pier which is highly stable when installed and capable of resisting extreme vertical and horizontal forces such as, for example, are commonly experienced during storm conditions.

Another object of the present invention is to provide a new and improved hinged connection system between adjacent sections of a modular pier.

Another object of the present invention is to provide a novel dolly which is equipped with a unique pier section hold down system which greatly facilitates both transportation of individual pier sections as well as installation or removal of such pier sections.

Another object of the present invention is to provide a dolly for both transportation and installation of individual pier sections which is equipped to be easily locked in place during the installation of a pier section, thereby preventing tipping or other dolly movement when the pier section is being lowered in place.

Another object of the present invention is to provide a novel dolly and a dolly locator for use in the assembly and disassembly of a modular pier wherein both the dolly and dolly locator are equipped to assure proper alignment and positioning of the dolly during such installation or removal.

Another object of the present invention is to provide an installation system for a pier assembly wherein hinge-forming components on respective pier sections of that assembly are in alignment for mateable alignment with each other during the installation.

Another object of the present invention is to provide a dolly for transportation and installation of individual pier sections of a pier assembly which dolly includes a pivotable pier section support platform and a lockable strut between the dolly chassis and such pier section support platform.

Another object of the present invention is to provide a dolly which is particularly suited for removal of modular pier sections in an installed pier assembly wherein the dolly includes an improved hook connection system that can be mounted to the end of a pier section to be removed and wherein the hook connection system includes a non-slip, lockable connection that will not move laterally along the end of such pier section even when the drag on the respective legs thereof is non-uniform.

These and other objects of the present invention will be apparent from the following detailed description, taken in conjunction with the accompanying drawings wherein a like reference numerals refer to like parts, in which:

FIG. 1 is a perspective view of a multiple section pier embodying one aspect of one aspect of the present invention;

FIG. 1*a* is a perspective view of a hinge bracket of the type shown in the FIG. 1 embodiment wherein the initial pier section is connected to an on-shore concrete block;

Figure 4B:
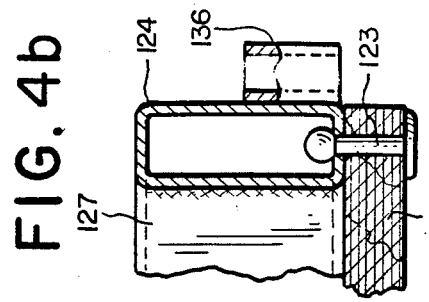
FIG. 4 is a bottom plan view of a pier section of the type shown in FIG. 1 with the leg portions thereof removed.
Figure 4A:
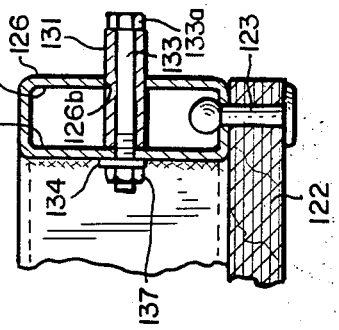
Figure 4:
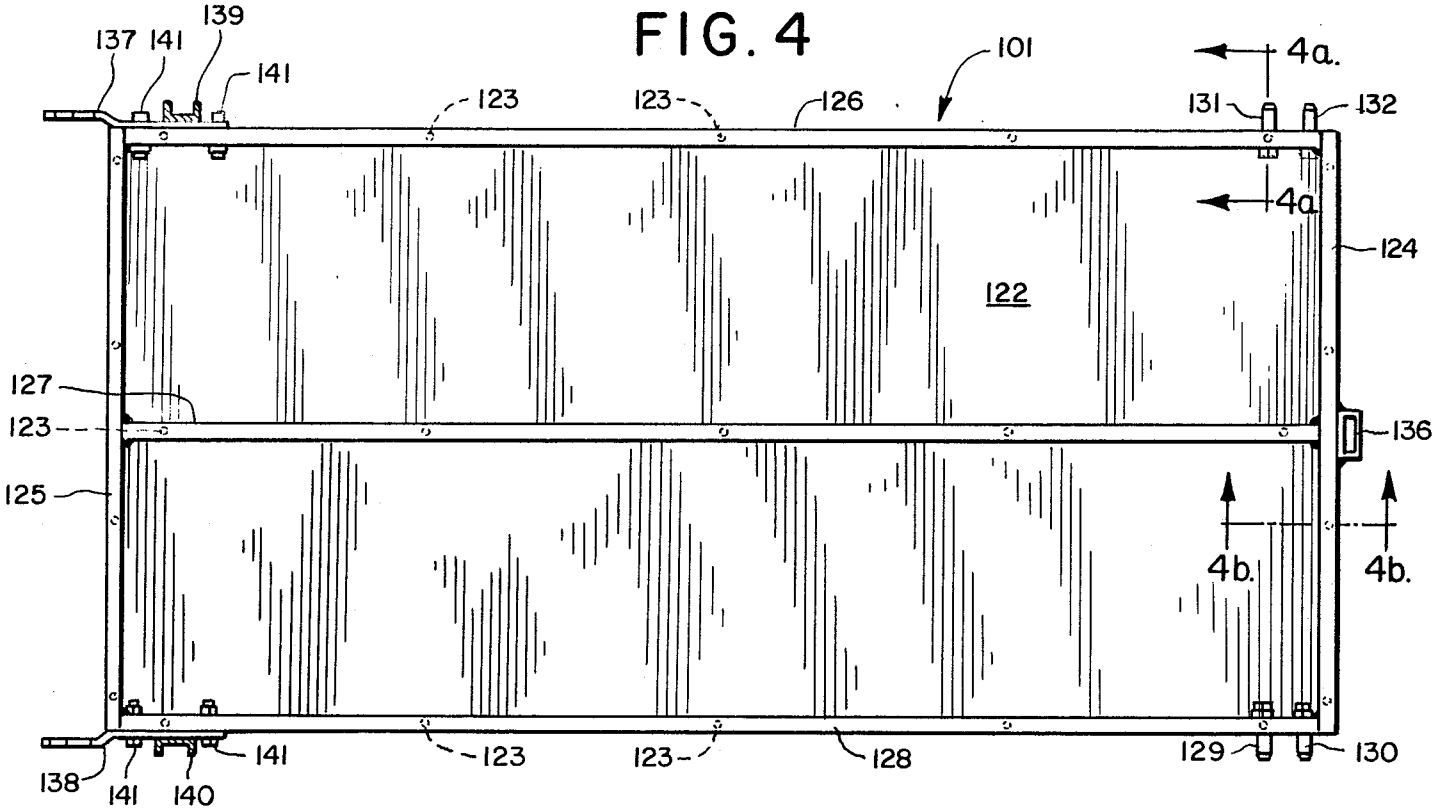
Figure 5:
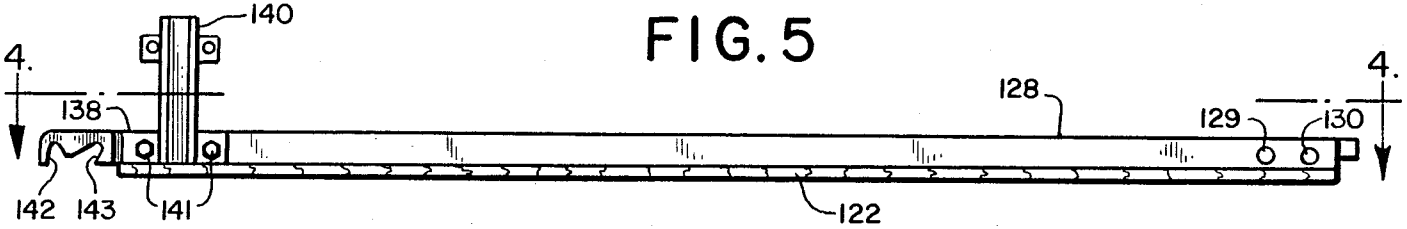
Figures 6, 7, 8, 8A:
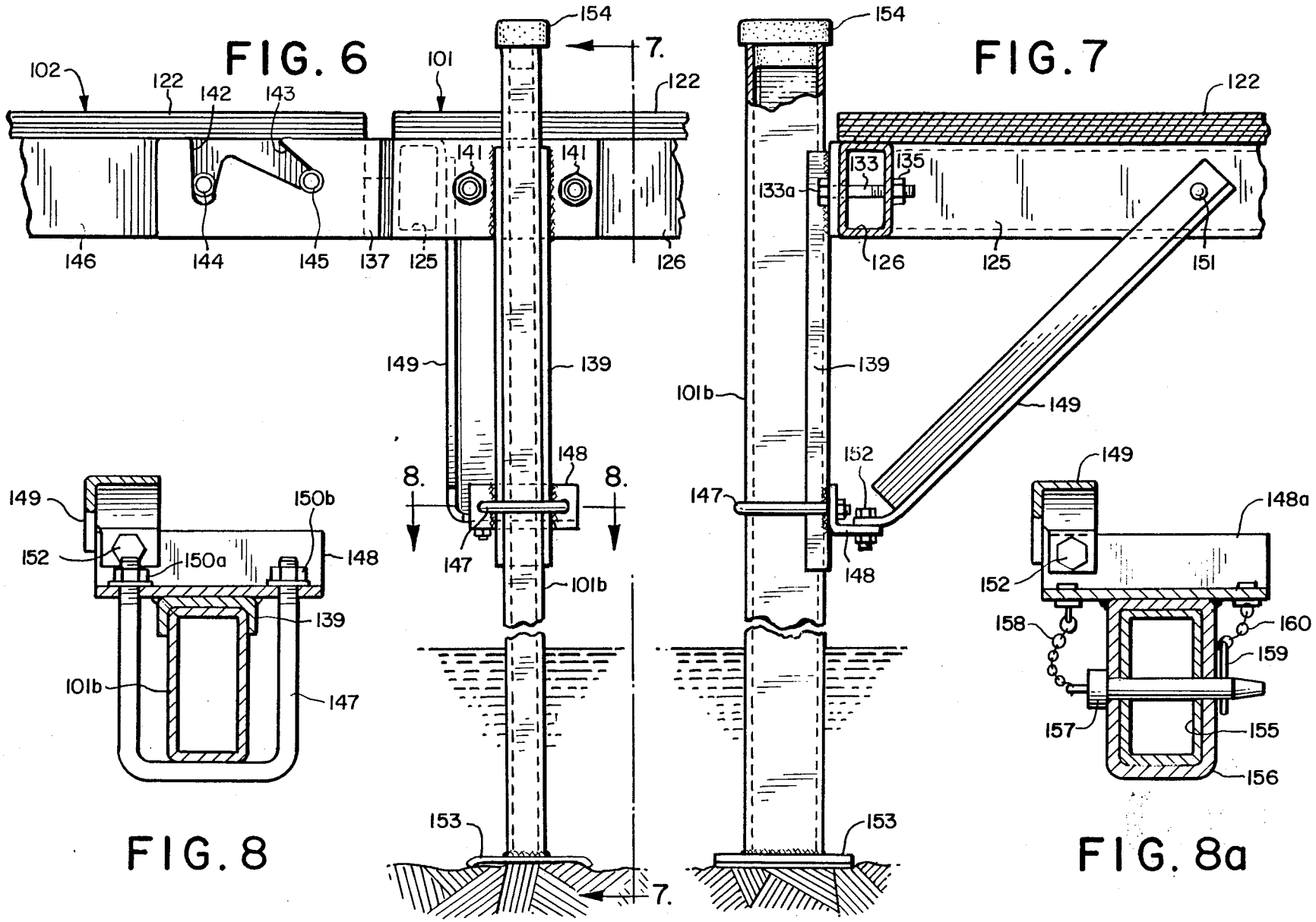
Figure 9:
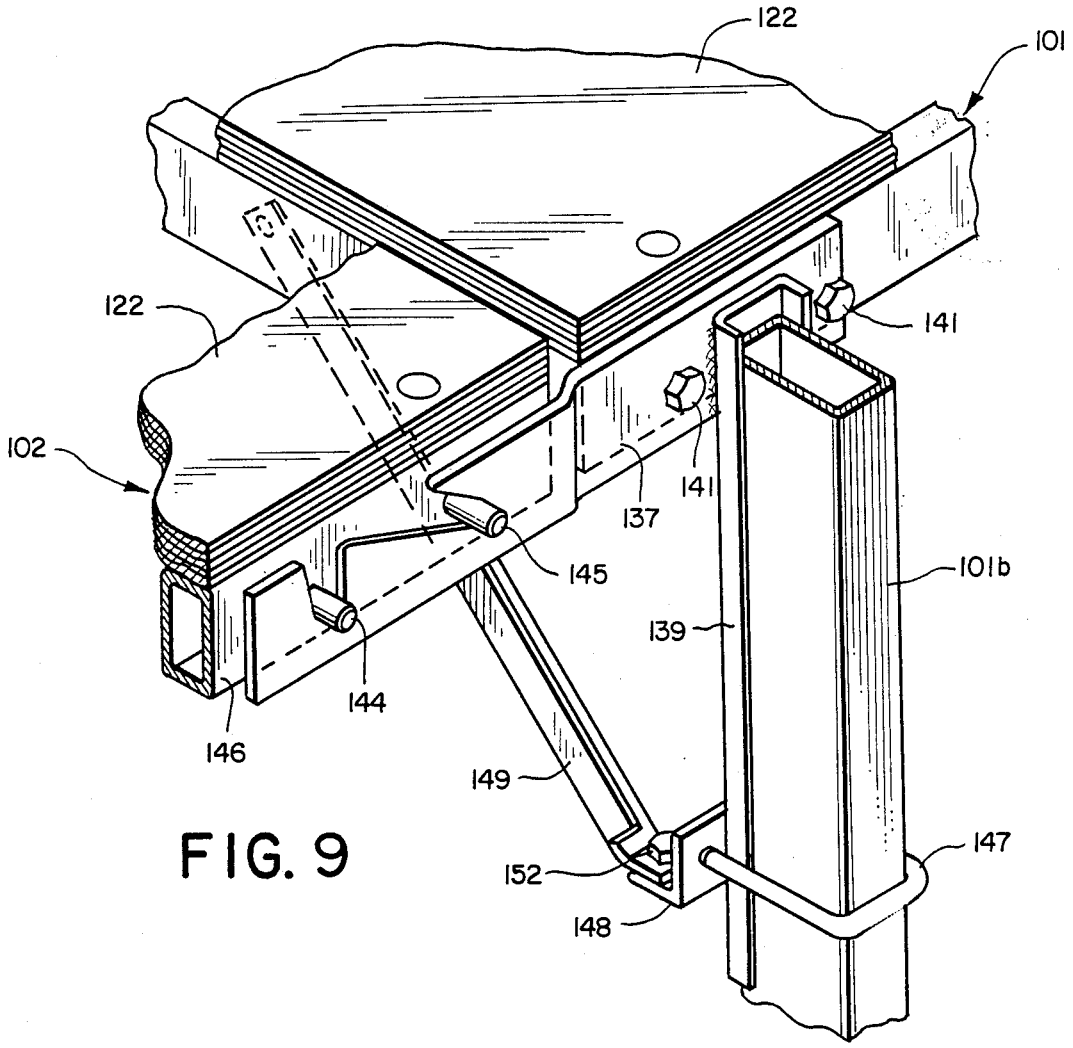
Figure 10:
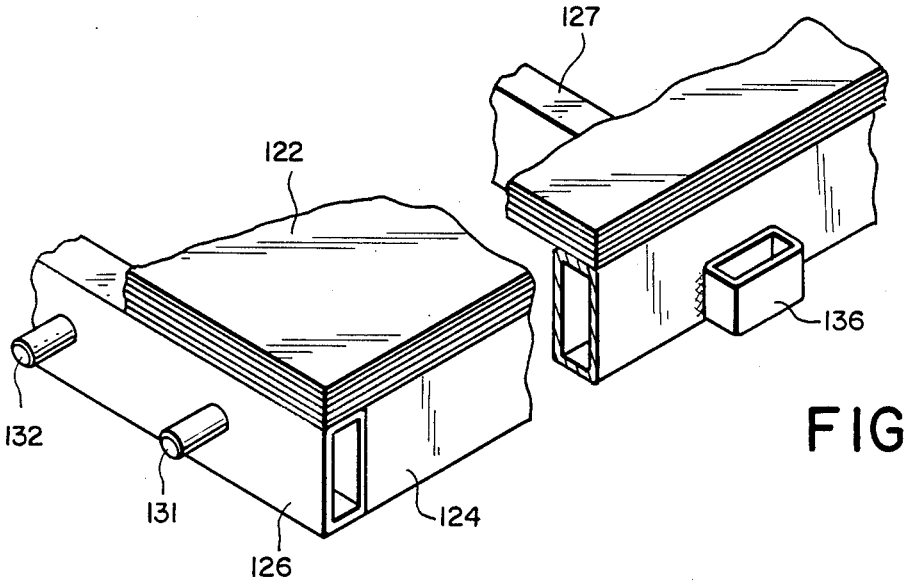
Figure 11:
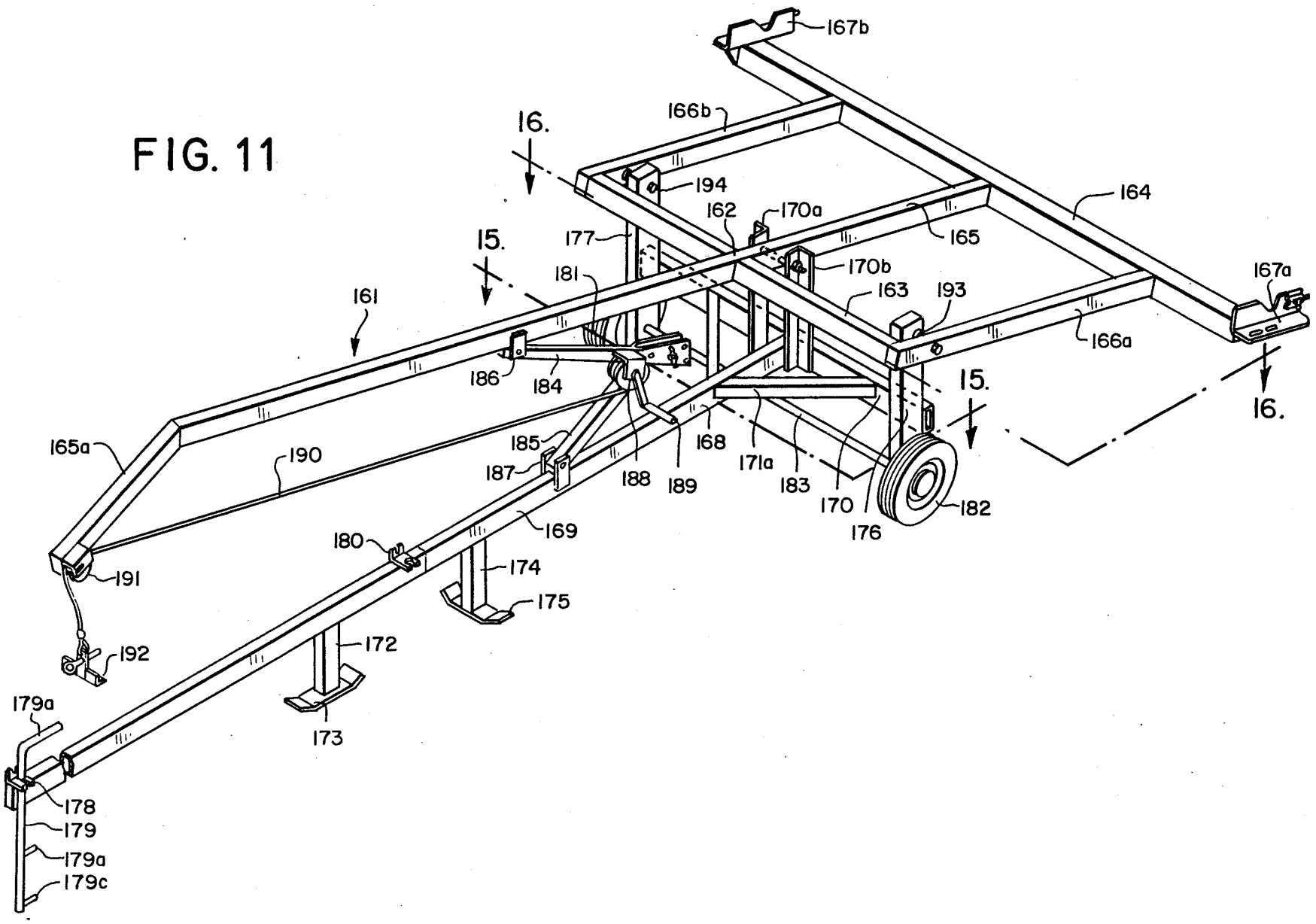
Figures 15, 16:
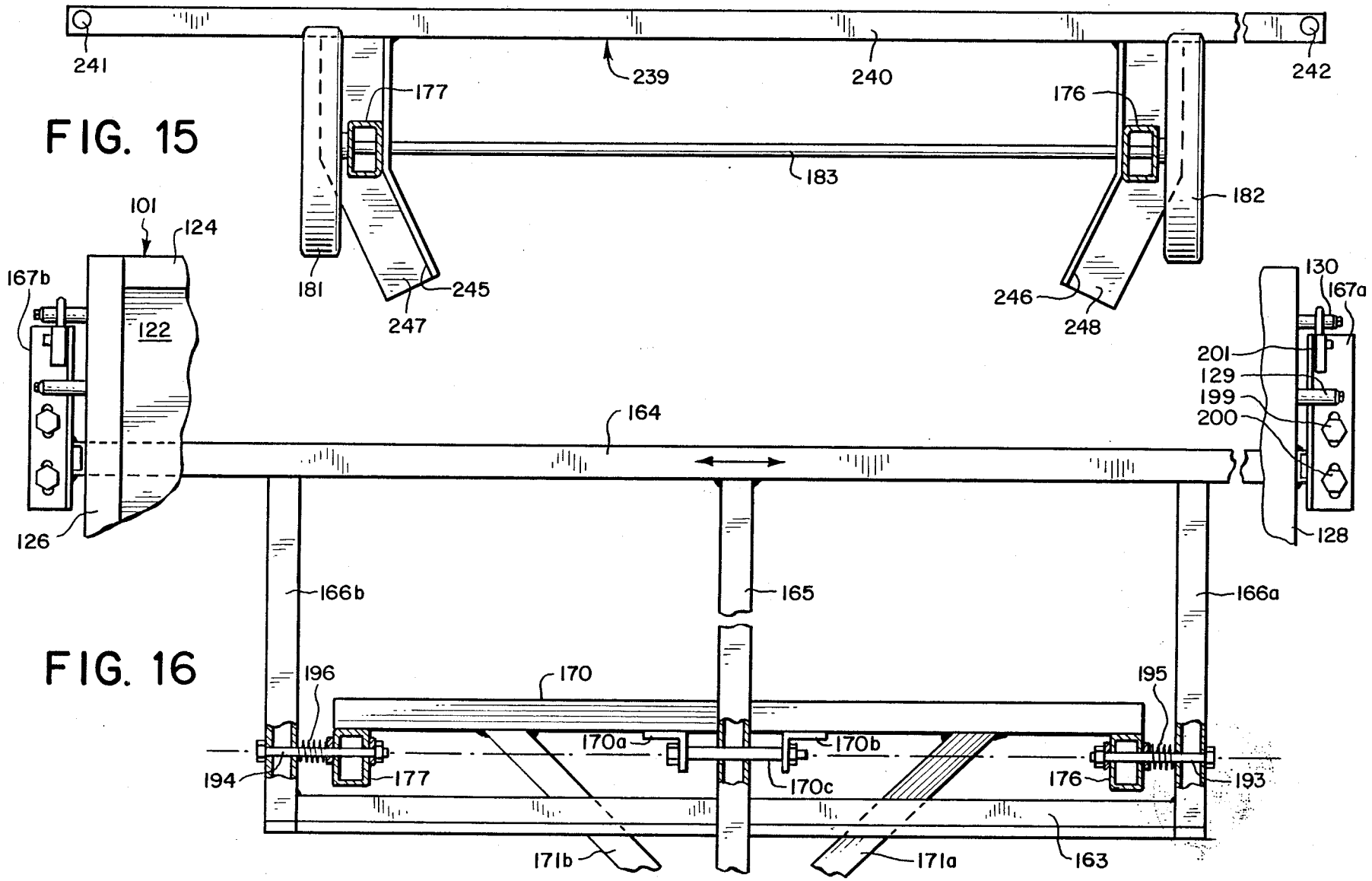
Figure 17:
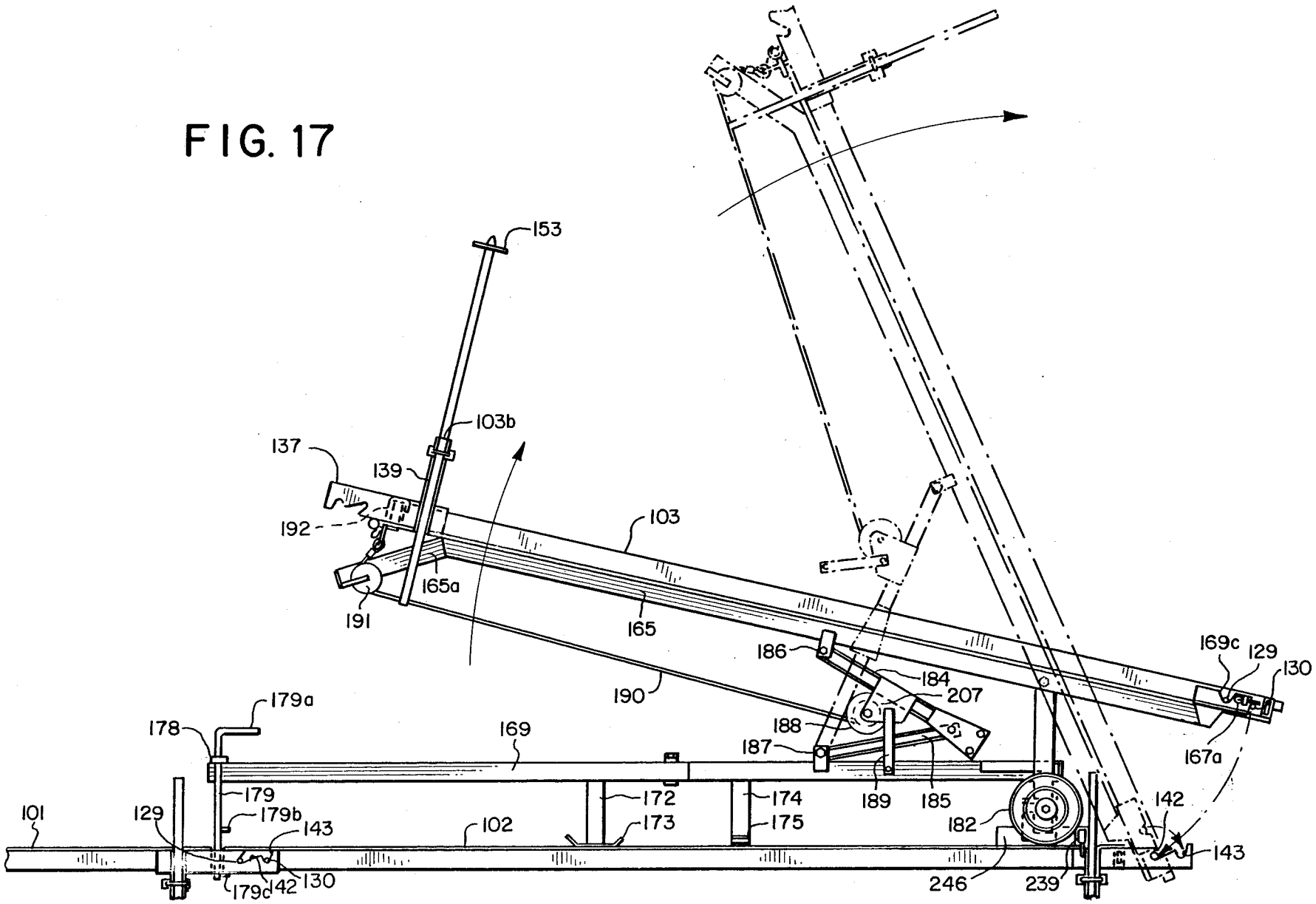
Figure 18:
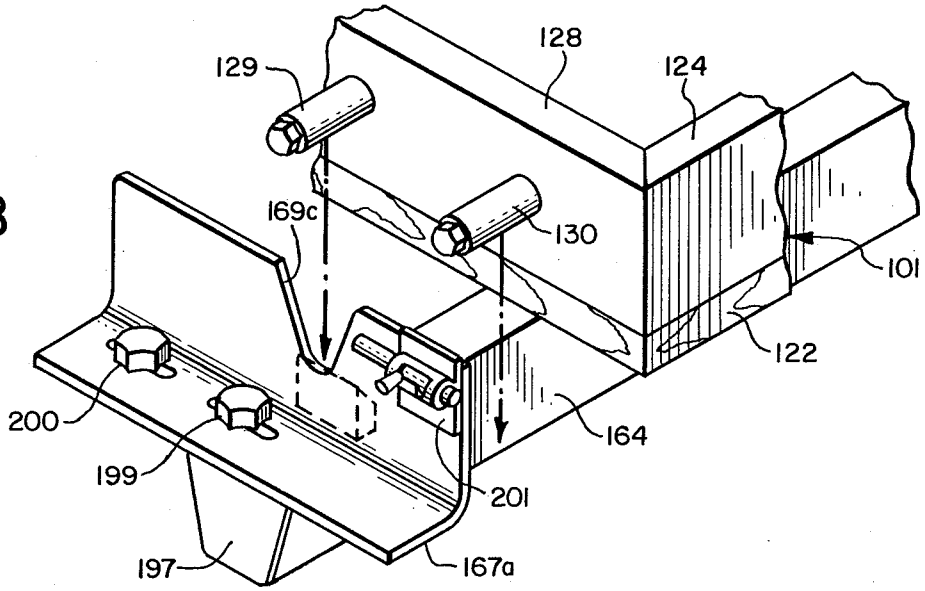
Figure 20:
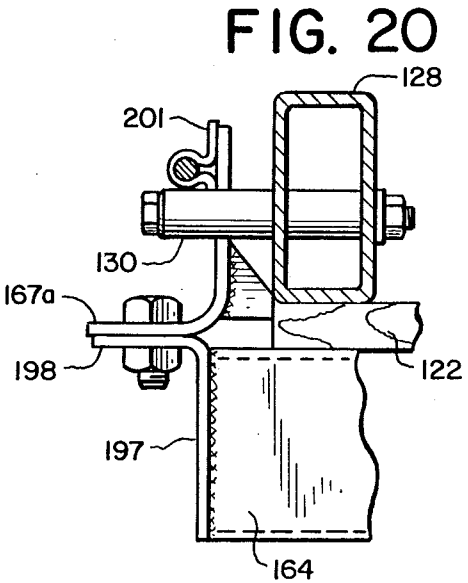
Figure 19:
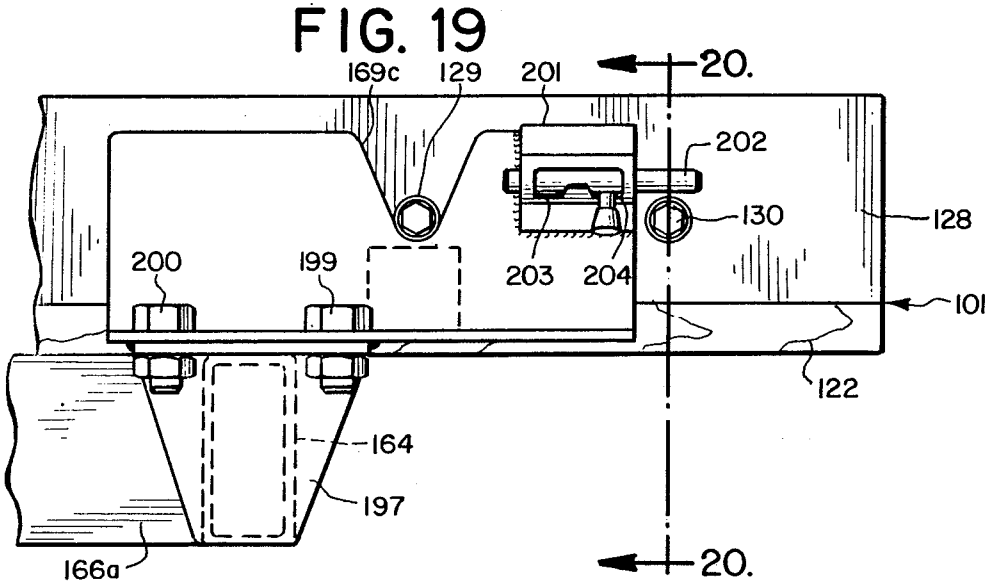
Figure 23:
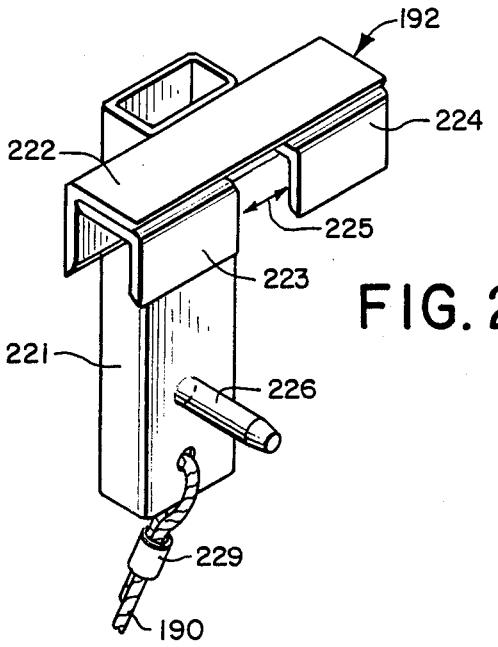
Figure 24:
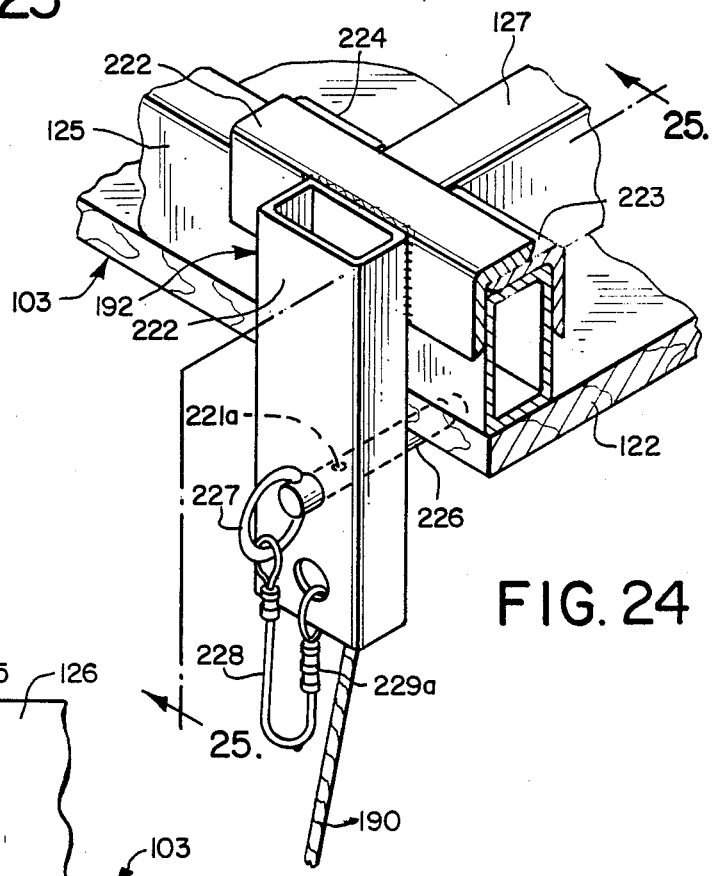
Figure 25:
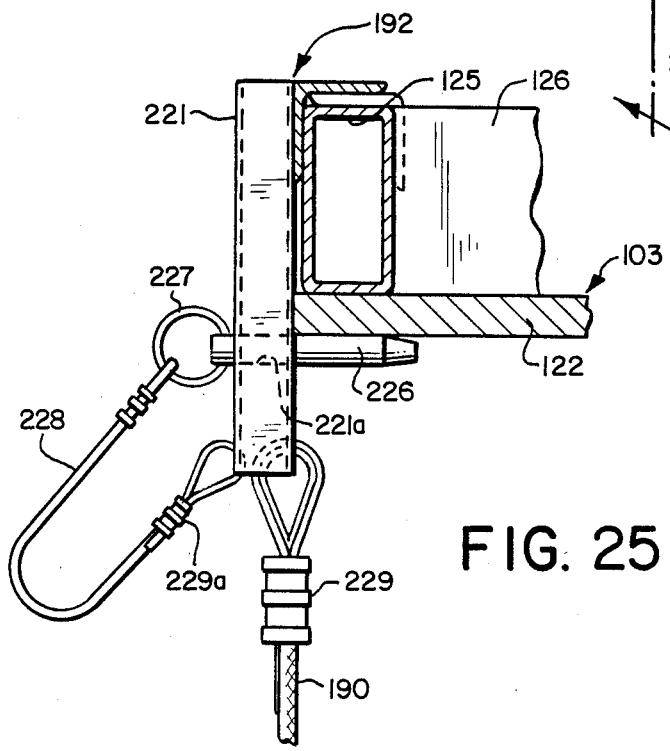

FIG. 4*a* is a sectional view taken along the line 4*a*—4*a* of FIG. 4;

FIG. 4*b* is a sectional view taken along the line 4*b*—4*b* of FIG. 4;

FIG. 5 is a side elevational view of the pier section shown in FIG. 4;

FIG. 6 is a fragmentary side elevational view, with portions thereof broken away, of a pair of interconnected pier sections of the present invention;

FIG. 7 is a sectional view taken along the line 7—7 of FIG. 6;

FIG. 8 is a sectional view taken along the line 8—8 illustrating one form of clamping device used to adjust the height of the pier leg;

FIG. 8*a* is a sectional view of alternate construction of pier leg height adjustment device which can be used with the present invention;

FIG. 9 is a fragmentary perspective view, with portions thereof broken away, illustrating the hinge bracket/hinge pin pier section interconnecting arrangement of the present invention;

FIG. 10 is a fragmentary perspective view with portions thereof broken away illustrating one end of a pier section of the present invention;

FIG. 11 is a perspective view illustrating a dolly embodying another aspect of the present invention;

FIG. 12 is a perspective view of a dolly locator embodying yet another aspect of the present invention with the dolly locator shown at one end of a pier section shown in phantom;

FIG. 13 is a side elevational view of the dolly locator shown in FIG. 12 with a portion of the dolly of FIG. 11 being shown in operative relationship therewith;

FIG. 14 is a sectional view taken along the line 14—14 of FIG. 12;

FIG. 15 is a partial sectional view taken along the line 15—15 of FIG. 11 illustrating the dolly locator and a portion of the dolly of FIG. 11;

FIG. 16 is a sectional view taken along the line 16—16 of FIG. 11 illustrating another portion of the dolly of FIG. 11 with a pier section (fragmentary view) supported thereon;

FIG. 17 is a side elevational view of the dolly shown in FIG. 11 with a pier section mounted thereon and illustrating the operation of the dolly (in phantom) during installation of a modular pier section in juxtaposition to a previously installed pier section;

FIG. 18 is a fragmentary perspective view of a pier section and the dolly arm hold down mechanism which forms a part of the dolly shown in FIG. 11;

FIG. 19 is a side elevational view of the dolly hold down mechanism shown in FIG. 18 with the pier section being fully secured therein;

FIG. 20 is a sectional view taken along the line 20—20 of FIG. 19;

FIG. 21 is a fragmentary perspective view of the dolly hold down mechanism shown in operative relationship to a pair of previously installed pier sections;

FIG. 22 is a fragmentary sectional view of the dolly hold down mechanism shown in FIG. 21;

FIG. 22*a* is a sectional view taken along the line 22*a*—22*a* of FIG. 22;

FIG. 22*b* is a sectional view taken along the line 22*b*—22*b* of FIG. 22;

FIG. 22*c* is a sectional view taken along the line 22*c*—22*c* of FIG. 22;

FIG. 23 is a fragmentary perspective view of the winch hook which forms a part of the dolly shown FIG. 11;

FIG. 24 is a fragmentary perspective view of the winch hook shown in FIG. 23 secured to one end of a pier section;

FIG. 25 is a sectional view taken along the line 25—25 of FIG. 24;

FIG. 26 is a fragmentary sectional view of the dolly shown in FIG. 11 illustrating the winch/strut portion thereof in a folded position;

FIG. 27 is a side elevational view with portions thereof broken away of the winch/strut shown in its fully extended position;

FIG. 28 is a sectional view taken along the line 28—28 of FIG. 27; and, FIGS. 29, 30, 30*a*, 31 and 32 are generally diagramatic, side elevational views illustrating the sequential steps involved in the installation of a modular pier section utilizing the multiple section pier and installation assembly of the present invention.

Figures 1, 1A, 2, 3:
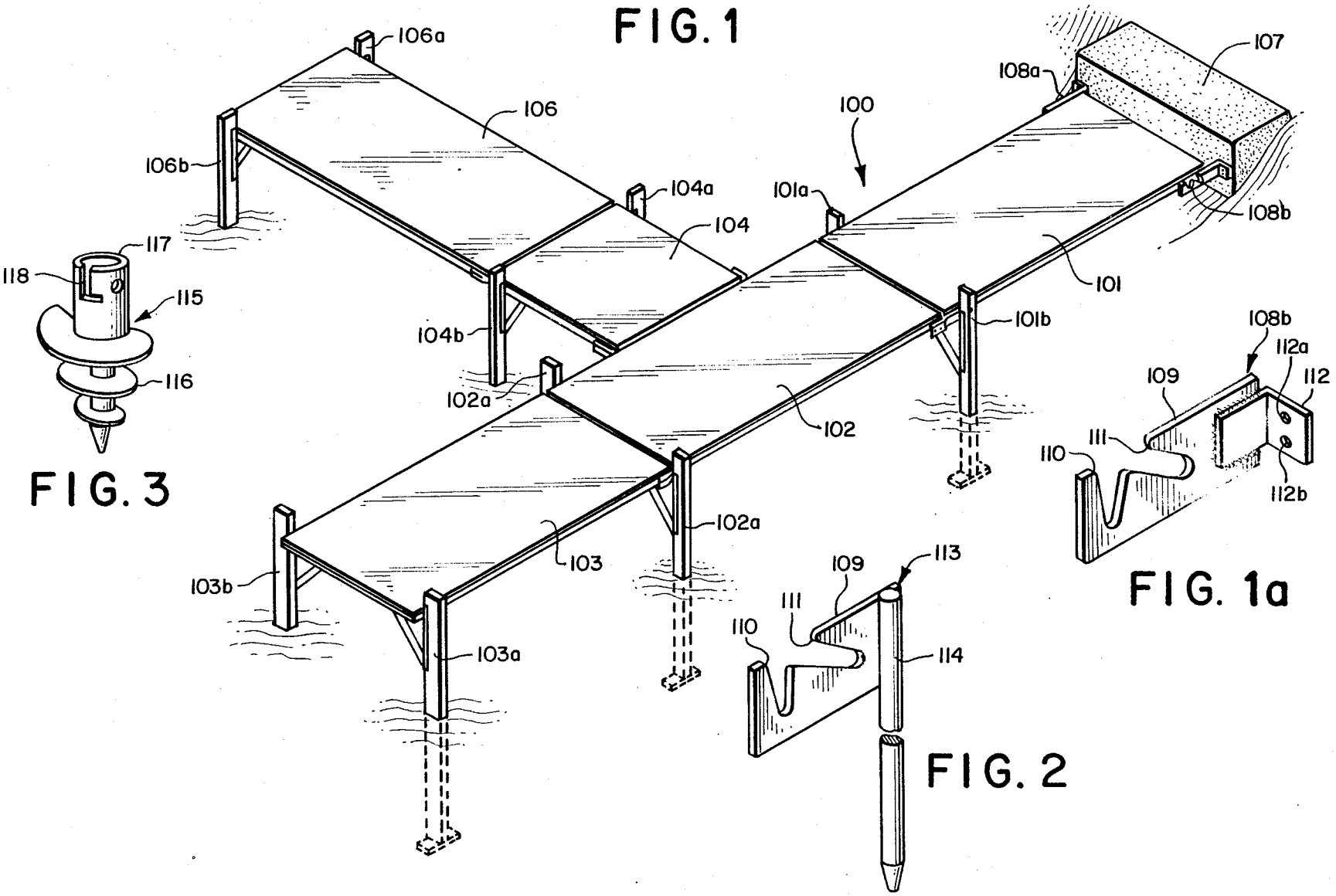
FIG. 2 is a perspective view of an alternate pier anchor bracket for use with installations wherein the initial pier section is connected to land (i.e. earth) or equivalent on-shore location.
FIG. 3 is a perspective view of a dolly hold down member which is equipped with an auger for use in installation of the initial pier section to a land (i.e. earth) on-shore location.

Referring to the drawings and, with particular reference to FIG. 1, the reference numeral 100 generally depicts an installed pier embodying the present invention. As shown, pier 100 includes a straight pier component formed from individual pier sections 101, 102 and 103 which are interconnected to each other in a manner to be described hereinafter. Installed pier 100 further includes a branched section composed of half-length pier section 104 and full length pier section 106 which likewise are interconnected to each other as will be described below. As shown, individual pier section 101 includes a pair of pier support legs 101*a* and 101*b* and individual pier sections 102, 103, 104 and 106 respectively include pier support legs 102*a* and 102*b*, 103*a* and 103*b*, 104*a* and 104*b*, and 106*a* and 106*b*.

In the illustrated embodiment shown in FIG. 1, pier section 101 is mounted to an on-shore concrete block 107 by means of a pair of hinge brackets 108*a* and 108*b*. As best shown in FIG. 1*a*, hinge bracket 108*b* includes a generally planar section 109 having a vertically extending open slot 110 and an angularly oriented open slot 111 which, as will be described more fully below, receive a pair of hinge pins mounted to and laterally extending from the sidewall portions of individual pier section 101. A mounting flange 112 is welded to hinge bracket plate 109. Plate 112 includes a pair of apertures which to receive mounting bolts to secure the hinge bracket to the concrete block 107.

In systems wherein the first pier section of an installed pier is directly connected to a land (i.e. earth) on-shore location, a hinge bracket 113 such as shown in FIG. 2 may be used. Hinge bracket 113 includes an earth spike 114 and a hinge plate 109 which is essentially identical to the hinge plate shown in FIG. 1*a*. Correspondingly, installation of the first pier section 101 to such a land on-shore location can be facilitated by the use of a dolly hold down member 115 having an earth auger 116 which extends downwardly from a cylindrical member 117 having an ended key or bayonet type slot 118 formed therein. The details of the use of dolly hold down member 115 will be explained in conjunction with the description of the dolly hold down system which is shown in greater detail in FIGS. 21, 22, 22*a*, 22*b* and 22*c*.

As shown in FIGS. 4, 4*a*, 4*b*, 5, 9 and 10, the individual pier sections in the illustrated embodiment include a rectangular welded steel tubular frame on which a plywood deck 122 is secured by a plurality of blind rivets having enlarged oval head portions 123*a* as best shown in FIGS. 4*a* and 4*b*. While the actual size of a pier section is not a feature of the present invention, it will be observed that in typical installations, the full length pier sections such as exemplified by pier section 101 will typically be eight feet in length and four feet in width, while half pier sections such as exemplified by pier section 104 will typically be four feet in length and four feet in width. The deck portions 122 in each of these pier sections can be composed of any suitable weather resistant material such as, for example, pressure treated, long life, exterior grade plywood.

Tubular frame 121, in the illustrated embodiment, generally includes transverse frame members 124 and 125 respectively located at first and second ends of the pier section 101. As shown, these transverse frame members are fixed, such as for example by welding, to longitudinal frame members 126, 127 and 128, with longitudinal frame members 126 and 128 forming opposite sidewalls of the pier section 101.

In accordance with one aspect of the present invention, the first end of pier section 101 is provided with a pair of hinge pins 129 and 130 that extend through tubular frame member 128 and a pair of hinge pins 131 and 132 which extend through frame member 126. These hinge pins can be fixed to their respective frame members in any suitable fashion which provides sufficient strength and rigidity to the hinge pin. One appropriate arrangement for mounting the hinge pins is illustrated in FIG. 4*a*. As shown therein, hinge pin 131 has a cylindrical configuration with one end thereof seated against the interior surface 126*a* of frame member 126 and with the pin itself extending through an aperture 126*b* formed in the opposing sidewall 126*c*. Aperture 126*b* is preferably sized to snugly receive the exterior surface of hinge pin 131 which is securely fixed to the frame member 126 by means of a bolt 133 that extends through the interior passageway of 131. Hexagonal head 133*a* is seated on the exterior end of hinge pin 131. The opposite end bolt 133 can be tightly clamped to the inside surface of sidewall portion 126*a* by means of a washer 134 and bolt 135. A dolly hold down bracket 136 of a rectangular configuration is welded to the transverse frame member 124 adjacent the longitudinal frame member 127.

The second end of pier section 101, adjacent transverse frame member 125, is provided with a pair of leg and hinge brackets 137 and 138. As shown in FIGS. 4 and 5, brackets 137 and 138 are respectively secured to side frame members 126 and 128 by bolts 141. U-shaped leg supports 139 and 140 are shown, in the illustrated embodiment, to be welded to brackets 137 and 138, respectively. As shown in FIG. 5, bracket 138 includes a vertically extending open ended slot 142 and an angularly oriented open slot 143 which, in accordance with one aspect of the present invention, cooperate with pier section hold down brackets on the dolly (as will be discussed more fully below) and also function to provide the novel hinged connection in the assembled pier which forms an important part of the present invention.

Referring to FIGS. 6, 7, 8 and 9, pier section 101 is illustrated in its assembled arrangement with pier section 102. As shown, hinge pins 144 and 145 which are secured to the tubular frame member 146 of pier section 102 are received within vertical slots 142 and 143, respectively. In this connection, it will be observed that hinge pin 144 and vertical slot 142 and their counterparts on the opposite side of the installed pier sections cooperate to resist both lateral and longitudinal movement of the pier sections 101 and 102. Correspondingly, angular slot 143 and hinge pin 145 and their counterparts on the opposite side of the installed pier sections cooperate to resist vertical movement of the pier sections 101 and 102.

Adjustment of the pier support leg 101*b* is provided by means of a U-shaped leg clamp which has a generally squared configuration conforming to the generally rectangular outer configuration of pier leg 101*b*. In this regard, it should be noted that, as shown, the individual pier legs are preferably of rectangular configuration with the major dimension thereof being perpendicular to the individual pier sections to provide improved structural strength. U-shaped clamp 147 is received within two apertures of an upwardly extending portion of a bracket 148 with the bight portions thereof being threaded and secured to the clamp by means of nuts 150*a* and 150*b*. The upper end of a brace 149 is secured by means of a bolt 151 to the frame member 125 and the lower end thereof secured to the bracket 148 by a bolt 152. As shown, pier support leg 101*b* can be freely raised or lowered by loosening the clamp 147, thereby permitting upward and downward travel of the leg 101*b* within the U-shaped leg support 139. The lower end of pier leg 101*b* is provided with a foot or pod-like base which is preferably welded to the bottom end of leg 101*b*. If desired, a suitable cap or plug 154 can be fitted at the upper end of the leg 101*b* to prevent entry of water or contaminants into the interior of the leg 101*b*.

Referring to FIG. 8*a*, an alternate pier leg arrangement is shown. In particular, pier leg 155 is received within a rectangular leg support 156 which, in turn, is welded to bracket 148*a* that is of generally similar construction to the previously described bracket 148. In this embodiment, each of rectangular leg 155 and rectangular leg support 156 is provided with a plurality of axially aligned passages that are adapted to receive a locking pin 157. As will be appreciated, locking pin can be removed from these passages to enable the leg 155 to be raised or lowered to provide the desired pier leg height. Insertion of pin 157 then prevents any relative movement between the leg support and the leg. If desired, a chain 158 can be used to retain the pin 157 and prevent the loss thereof and a cotter pin which is received within a transverse aperture in the end of locking pin 157 can be used to prevent an advertent withdrawal of the pin 157. A suitable chain or cable 160 can likewise be employed to retain cotter pin 159 and eliminate any inadvertent loss thereof.

Referring to FIGS. 11 and 16, the reference 161 generally designates a dolly which constitutes another important aspect of the present invention. As shown, dolly 161 includes a pier section support unit 162 having a pair of transverse frame members 163 and 164 and longitudinal frame members 165 and 166*a* and 166*b* which have upper surface portions that generally lie in a common plane for receiving thereon the deck portion 122 of a pier section which is to be installed utilizing the dolly 161. A pair of dolly arm hold down brackets 167*a* and 167*b* (the construction and operation of which will be described more fully in conjunction with FIGS. 18–20) are mounted to opposite ends of transverse frame member 164.

Dolly 161 further includes a chassis 168 having a longitudinal chassis frame member 169, a transverse chassis frame member 170 and a pair of braces 171*a* and 171*b* which provide improved rigidity to the chassis. Support legs 172 and 174 downwardly extend from the longitudinal chassis frame member 169 and respectively are provided with dolly arm skids 174 and 175.

Upwardly extending from the opposite sides of transverse chassis frame member 170 are a pair of vertical fixed dolly legs 176 and 177. Pier section support member 162 is pivotally mounted to the upper ends of the vertical legs 176 and 177 in a manner which will be described more fully in conjunction with FIG. 16.

In order to resist upward forces on the dolly caused by pivotal movement of the pier section support unit 162, a suitable hold down mechanism is provided. In the illustrated embodiment, this dolly hold down mechanism includes a hold down plate 178 located at one end of the longitudinal chassis frame member 169, the precise location of such plate being dictated by the location of the hold down bracket 136 on the previously installed pier section as will be more fully described in conjunction with FIGS. 21, 22, 22*a*, 22*b* and 22*c*. As shown in FIG. 11, however, it will be observed that the illustrated hold down mechanism includes a dolly hold down rod 179 which is both rotatable and vertically movable within an aperture formed in the plate 178. In this regard, it will be observed, as best shown in FIGS. 21 and 22, that the hold down plate 178 preferably includes dual spaced apart plates 178*a* and 178*b*. As shown in FIG. 11, hold down rod 179 has a handle portion 179*a* and a pair of hold down pins 179*b* and 179*c*. In order to accommodate pier sections of a shorter length such as, for example, pier section 104 (FIG. 1) an optional additional hold down plate 180 may be provided.

Transportation of the dolly 161 is facilitated by a pair of wheels 181, 182 which are mounted to rigid vertical arms 176, 177. If desired, an axial 183 interconnecting wheels 181 and 182 may likewise be provided.

A strut assembly including an upper strut arm 184 and a lower strut arm 185 is pivotally mounted to longitudinal frame member 165 and longitudinal chassis frame member 169 by the brackets designated by referenced 186 and 187. In the illustrated embodiment, a winch 188 is mounted to upper strut arm 184. The structure and operation of winch 188 and its associated strut assembly will be described more fully in conjunction with FIGS. 26, 27 and 28. As shown in FIG. 11, winch 188 generally includes a winch handle 189 and a rope or cable 190 which extends therefrom and around pulley 191. The end of the cable or rope 190 is provided with a winch hook 192 which is more fully shown and described in conjunction with FIGS. 23, 24 and 25.

Referring to FIG. 16, it will be observed that pier section support unit 162 is pivotally mounted to the dolly 161 with longitudinal frame members 166*a* and 166*b* pivotally supported to the upper ends of fixed vertical legs 176 and 177 by pins 193 and 194, respectively. Correspondingly, the longitudinal frame member 165 of unit 162 is pivotally supported to the upper ends of angle irons 170*a* and 170*b* by a pin 170*c*. In this regard, it will be appreciated that the unit 162 is capable of limited transverse movement in both directions to facilitate registry of the hinge pin-hinge plate connecting means at ends of previously installed pier section 101 and the to-be-installed pier section 102. If desired, a pair of coil springs 195 and 196 interposed between fixed vertical legs 176, 177 and longitudinal frame sections 166*a*, 166*b* can be employed to provide self centering of the pier section support unit 162 with respect to dolly 161.

FIGS. 18–20 depict the structure and operation of dolly arm hold down brackets 167*a* and 167*b*. As previously noted, these brackets are mounted to the outer ends of the second transverse frame member 164 of pier section support unit 162 by means of an end plate 197 which is welded to each of the terminal portions of second transverse frame member 164. As best shown in FIG. 20, end plate 197 includes an outwardly flanged portion 198 having a pair of slots which are aligned with like slots on the dolly arm hold down bracket 167*a*. A pair of bolts 199, 200 secure the bracket 167*a* to flange 198. As shown in FIG. 18, the respective apertures of the flange 198 and bracket 167*a* are slotted to permit adjustment of the position of the bracket 167*a* with respect to the second transverse frame member 164. It will, of course, be appreciated that the interaction of hinge pins 129, 130 of pier section 101 or with dolly arm hold down bracket 167*a* is the same as the interaction of hinge pins 131, 132 with dolly arm hold down bracket 167*b*.

Referring to FIG. 18, pier section 101 is arranged so that its first end adjacent transverse frame member 124 is placed in overlying relationship with the forward end of pier section support member 122 with hinge pin 129 positioned to be received within vertical slot 169*c* of bracket 167*a* and with hinge pin 130 positioned so that it will lie forwardly of bracket 167*a*. As shown, the forward end of bracket 167*a* is provided with a latch 201 having a slide bolt 202 which is movable between a first position designated by notch 203 and a second position designated by notch 204 (FIG. 19). In this regard, it will be observed that the slide bolt 201 is placed in latch position 203 when the pier section 101 is lowered on to the pier section support unit 162. Slide bolt 202 is then placed in the second latch position (FIG. 19) so that the slide bolt overlies the hinge pin 130. This enables the first end portion of pier section 101 to be securely retained on the pier section support unit 162 when it is pivoted during installation of the pier section which is supported thereon.

FIGS. 21, 22 and 22*a–c* depict the structure and operation of the dolly hold down mechanism which provides an advantageous safety feature of this invention by serving to resist upward forces on the dolly caused by pivotal movement of the pier section support unit 162 during installation and removal of a pier section. In the illustrated embodiment, a pair of dolly hold down plates 178*a* and 178*b* are mounted to the longitudinal chassis frame member 169. As shown, plate 178*a* includes a slotted aperture 178*c* which is in axial alignment with a like aperture 178*d* in plate 178*b*. These apertures are sized so as to permit vertical and rotational movement of the hold down rod 179. The hold down pins 179*b* and 179*c* are in alignment with each other, with pin 179*c* being sized so that it can be received within and pass through the open interior portion of dolly hold down bracket 136. An upwardly extending slotted flange portion 178*e* on plate 178*a* is slotted so that it can receive transverse support rods 179*f* located adjacent the upper end of rod 179 for holding the rod 179 clear of the ground transporting of the dolly 161. Correspondingly, each of plates 178*a* and 178*b* is provided with a slot therein which is slightly larger than the pins 179*b* and 179*c* to enable removal of the rod 179 for use in association with another pair of hold down plates located elsewhere on the longitudinal chassis frame member 169 in order to accommodate use of the dolly hold down mechanism with pier sections of different lengths.

As will be more fully described in conjunction with FIGS. 29–32, during installation of pier section 103 the dolly is positioned on pier section 102 and the hold down rod 179 passed between transverse frame member 125 of pier section 101 and transverse frame member 124 of pier section 102 (see FIGS. 21 and 22). In this regard, it will be appreciated that when the initial pier section 101 is installed and there are no previously installed pier sections to receive the hold down rod 179, a dolly hold down device such as that designated by the referenced 115 (FIG. 3) can be used. Hold down device 115 includes a cylindrical member having a locking pin aperture or key slot 118 which is sized to lockingly receive the pin 179*c* of hold down rod 179 and an auger 116 enabling it to be firmly anchored to an on-shore location.

FIGS. 26–28 depict the structure and operation of the strut assembly. As previously noted, the strut assembly includes an upper strut art 184 which is pivotally connected to pier section support longitudinal frame member 165 as designated by the referenced 186 and a lower strut arm 185 which, in turn, is pivotally connected to the chassis longitudinal frame member 169 as designated by the referenced 187. As best shown in FIG. 26, winch 188 includes a housing 207 bolted to a winch bracket 208 on upper strut arm 184. The lower end of upper strut arm 184 includes a pair of strut plates between which the tubular body of lower strut assembly 185 is received. A pair of pivot pins 211, 212 interconnect the upper portion of lower strut arm 185 to the upper strut arm 184. Pivoting of the pier section support unit 162 results in the dolly strut assembly being unfolded into its fully extended arrangement as shown in FIG. 27. In the fully extended position the strut assembly 184, 185 is stable due to the fact that the upper arm 184 is slightly off center from the lower arm 185. Additional security to prevent inadvertent collapse of the double strut assembly can be provided by a locking pin 213 which is adapted to be received within a pair of apertures 216 located in each of the strut plates 209, 210. A strut plate connecting pin 217 located on the lower portion of each of the strut plates 210, 211 thereby cooperates with locking pin 213 to provide a safe and highly stable fully extended strut arm assembly as shown in FIG. 27. If desired, locking pin 213 can be secured to strut plate 210 by means of a cable 214 and connecting ring 215.

As best shown in FIGS. 23–25, the cable or rope 190 extending from winch 188 passes over pulley 191 and is connected to a winch hook 192 having a steel body 221 which, in the illustrated embodiment, is of rectangular cross-section. A full extent angle iron 222 is welded to the upper end of steel body 221 and a pair of partial extent angle irons 223, 224 are welded to the inside surface of the upper portion of the full extent angle iron 222. As shown, a gap 225 is provided between each of the partial extent angle irons 223, 224 which is sized to receive the center longitudinal frame member 127 of pier section 103. The interior profile of the structure defined by angle irons 222, 223 and 224 is in conformity with and sized to accommodate the transverse frame member 125 of pier section 103. Winch hook 192 is fitted around pier section 103 adjacent the second end thereof in a straddling relationship with transverse longitudinal frame members 125, 127.

Positive locking of the winch bracket 192 around the above designated frame portions of pier section 103 is achieved by means of a lock pin 226 which is sized to be received within an aperture 221*a* in winch hook body portion 221. As best shown in FIGS. 24 and 25, the aperture 221*a* is positioned so that it snugly accommodates the full thickness of pier section 103.

In order to protect against inadvertent loss of locking pin 226, a security ring 227 and cable connection 228 can be provided to permanently retain the locking pin in close proximity to the winch bracket 192. Cable or rope 190 and cable or rope 228 can be secured to the body portion 221 by the use of suitable pressed sleeves 229 and 229*a*. Of course, other suitable fastening means will be apparent to those skilled in this art.

Referring to FIGS. 12, 13 and 16, the reference 239 generally designates a dolly locator which constitutes another important aspect of the present invention In the embodiment illustrated in the drawings, dolly locator 239 includes a transverse cross member 240 which can be of tubular construction having a pair of locating studs 241, 242 extending downwardly from cross member 239 and are spaced apart so that they overlie the leg and hinge brackets 137 on opposite sides of the previously installed pier section 102. As such, these studs provide transverse alignment that assures proper positioning of the dolly locator 239 at a selected transverse location on the pier section 102. Correspondingly, as shown, cross member 240 is adapted to engage each of pier legs 102*a*, 102*b* to thereby limit travel of the dolly locator in the direction towards the second end of pier section 102 (the end adjacent cross frame member 125).

A pair of guide plates 243, 244 are welded to cross member 240 and are adapted to cooperate with the dolly 161 for insuring proper alignment of the dolly with respect to pier section 102 so as to facilitate either installation of pier section 103 adjacent the end thereof or, alternatively, removal of pier section 103 during this disassembly. Each of the guide plates 243, 244 is respectively provided with dolly arm skid portions 245, 246 which, in the illustrated embodiment, are formed from angle irons and function to guide the fixed dolly legs 176 and 177. The dolly arm skids 245, 246 respectively include outwardly extending flange portions 247, 248 which are located so that they contact the wheels 181, 182 during positioning of the dolly. If desired, dolly arm skids 245, 246 can be equipped with respective dolly axial locator plates 249, 250, each of which is provided with an open ended slot sized to receive the axle 183 which interconnects wheels 181, 182.

As best shown in FIGS. 13 and 15, the upwardly extending flanges on dolly arm skids 245, 246 respectively engage the inner surfaces of vertical legs 177, 176 for the purpose of facilitating alignment of the dolly as previously noted.

Operation of the multiple section pier and installation assembly of the present invention is best depicted by reference to FIGS. 17, 29, 30, 30*a*, 31 and 32. In the installation sequence depicted in these Figures, it will be observed that pier sections 101 and 102 have already been installed and that pier section 103 is shown in the various stages of installation.

Installation initially commences with placement of the pier section 103 on the pier section support unit 162 of dolly 161. Pier section 103 is lifted and placed onto pier section support unit 162 with the deck portion 162 thereof being placed against the upper surface of the pier section support unit 162. Hinge pin 129 is received within the vertical slot 169*c* of dolly arm hold down bracket 167*a*. Correspondingly, counter-part hinge pin 131 on the opposite side of the pier section is received within a similar vertical slot in bracket 167*b* (not illustrated). Slide bolt 202 is then moved to the second position depicted by the reference 204 in FIG. 19 so that it overlies and secures hinge pin 130. Winch hook 192 is then secured to the opposite end of pier section 103 in the manner as was previously described in conjunction with FIGS. 23–25. After the forward and rearward ends of the pier section 103 are thus secured on the pier section support unit 162, the dolly is then ready to be manually rolled on to the previously installed pier sections 101 and 102.

Figure 29:
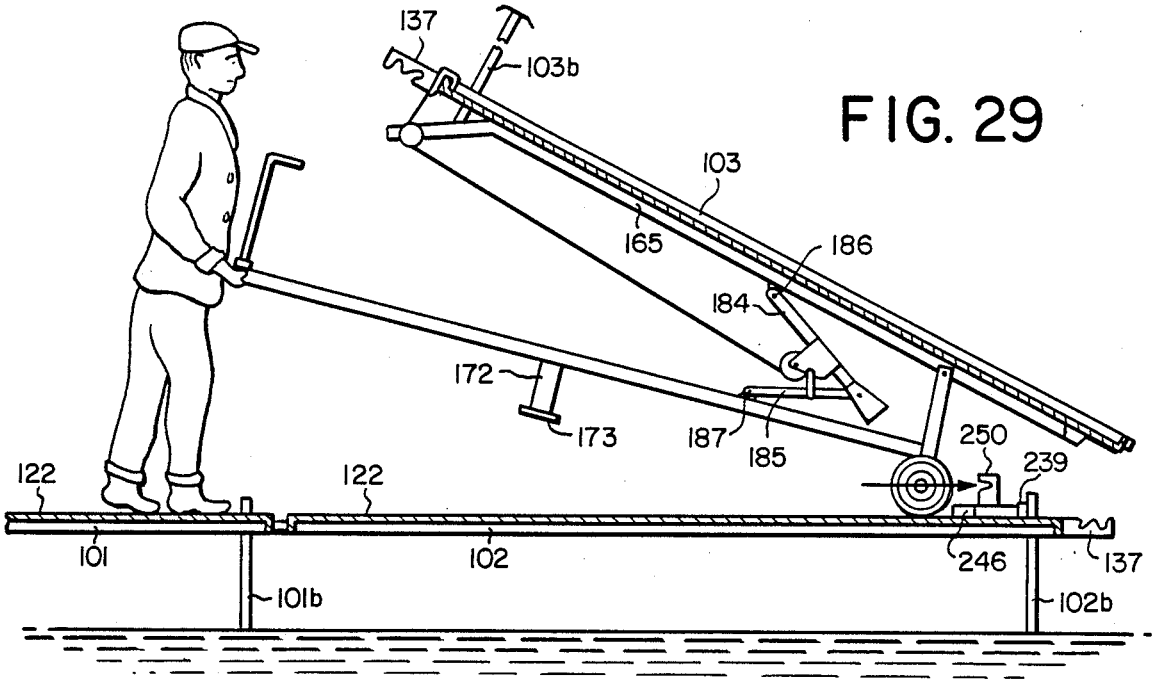
Figure 30:
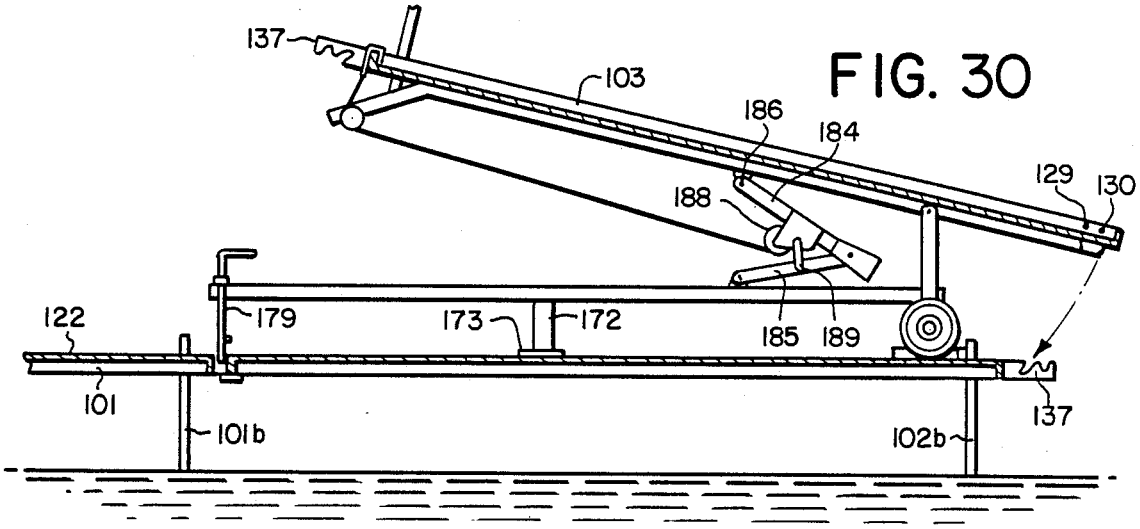
Figure 30A:
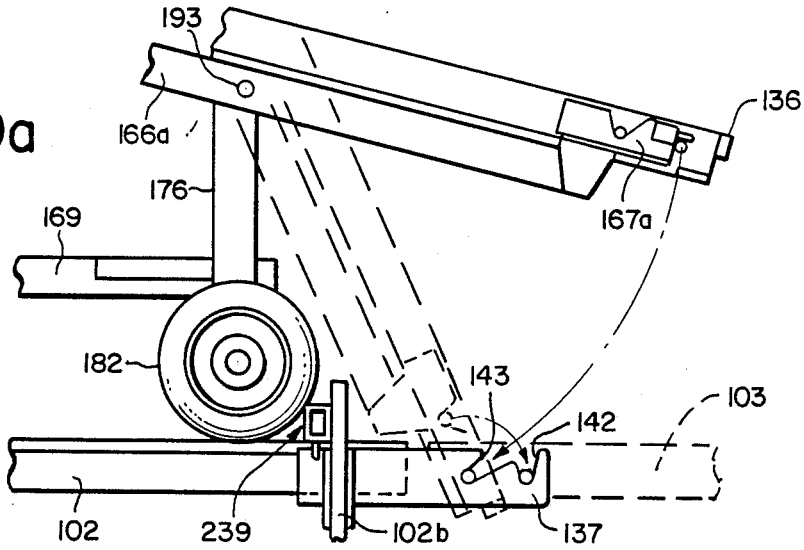
Figure 32:
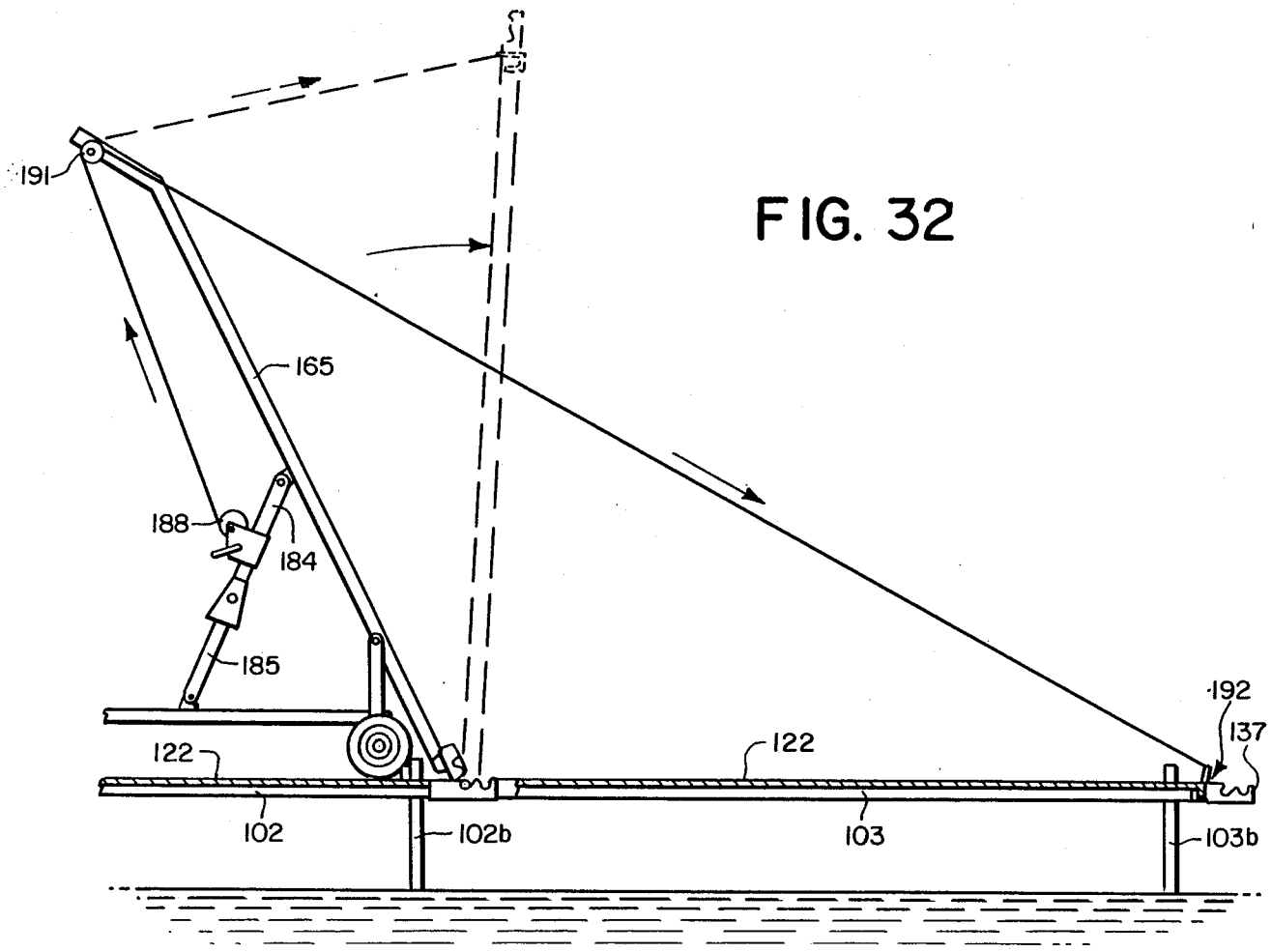
Figure 31:
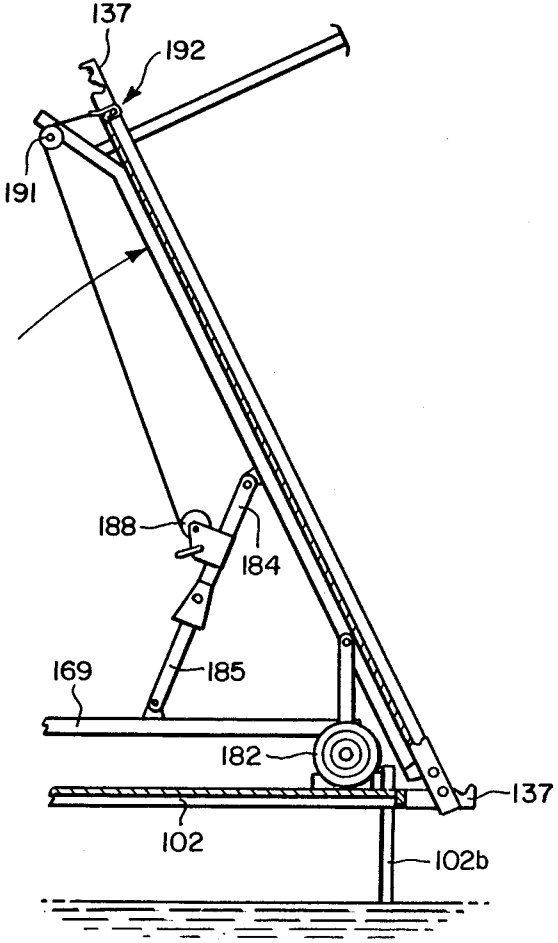

As shown in FIG. 29, dolly locator 239 has been previously placed at the end of pier section 102 in the manner described in conjunction with FIGS. 12, 13 and 15. The dolly is then rolled into positive engagement with the dolly locator 239. Once the dolly is firmly in place, the dolly hold down pin 179 is then fitted within hold down bracket 136 as was described in conjunction with FIGS. 21, 22 and 22*a–c*.

The pier section 103 is now in position to be manually raised until the dolly strut arms 104 and 105 unfold into their fully extended position. The winch 188 can then be operated to lower the pier section 103 causing the pins 129 and 130 to be received within slots 142 and 143 of hinge bracket 137. In this regard, it should be noted that the operator may optionally elect to lower the section 103 by pushing the pier section over center and then letting it fall under its own weight into proper position.

In the event that the pier section 103 that is being installed is not level, it can be easily raised out of the water by using the winch 188 and the legs 103*a* and/or 103*b* appropriately adjusted in the manner described in conjunction with FIGS. 6, 7, 8 and 8*a*. As will be appreciated, this leg adjustment can be done without requiring the operator to enter the water and usually is only required during the initial pier installation.

After the pier section 103 is lowered into place and leveled, the next section is ready to be installed. The winch bracket 192 is removed from the end of pier section 103 and the winch rope or cable 190 rewound onto the winch. The struts 184 and 185 are folded down, the hold down pin 192 released and the dolly then rolled back off the pier for installation of the next section.

It will, of course, be appreciated that removal of pier sections can be accomplished in the reverse sequence. Namely, the dolly locator 239 is positioned behind the section to be removed, the dolly 161 pushed into position, and the hold down pin 192 then inserted into its operative position. The dolly struts 184 and 185 are then raised and the winch line 192 pulled out a sufficient distance to allow attachment of the winch hook 192. Winch 188 is then operated to raise the pier out of the water. It will be appreciated that dolly 161 by use of the winch bracket is able to provide a substantially greater vertical lift than could be applied by a single individual. For example, a dolly winch in the illustrated embodiment can provide as much as a 300 lb. or greater vertical lift to a previously installed pier section, which lifting force far exceeds that of a man in the water.

It will be apparent to those skilled in this art that the present invention and the various aspects thereof can be embodied in other forms of modular pier constructions and installation assemblies and that modifications and variations therefrom can be made without departing from the spirit and scope of this invention Accordingly, this invention is to be construed and limited only by the scope of the appended claims.

I claim:

1. A multiple section pier and installation assembly, comprising:

a generally planar elongated first pier section having a first end and a second end oppositely disposed with respect to said first end, a pair of support legs mounted to opposite sides of said first pier section adjacent said second end thereof in generally perpendicular relation therewith, first connecting means mounted to said first end of said first pier section and adapted to be detachably connected to an on-shore location or a previously installed pier section, second pier section connecting means mounted to said second end of said first pier section, a generally planar elongated second pier section having a first end and a second end oppositely disposed with respect to said first end of said second pier section, third connecting means mounted to said first end of said second pier section and adapted to be hingedly coupled to said second connecting means, fourth connecting means mounted to said second end of said second pier section, and a pair of vertically extending support legs mounted to opposite sides of said second pier section adjacent said second end thereof in generally perpendicular relation therewith;

a dolly, said dolly including a chassis and a pier section support member, said second pier section being supported on said pier section support member, pier section hold down means mounted at one end of said pier section support member, clamping means adjacent a second end of said support member, said support member being pivotally mounted to said dolly chassis for rotation about an axis which is interposed between the first and second ends of said support member, said pier section hold down means being releasably secured to said third connecting means, and said clamping means being releasably secured to said second end of said second pier section;

a dolly locator, said dolly locator being adapted to be positioned on said first pier section, stop means on said first pier section for limiting travel of said dolly locator in the direction of said second end of said first pier section to a selected position adjacent said second end of said first pier section, transverse alignment means on said dolly locator for positioning said dolly locator at a selected transverse location on said first pier section, and guide means on said dolly locator cooperative with said dolly for receiving and positioning said dolly at a selected location on said first pier section during installation of said second pier section;

whereby, alignment of said second pier section with said first pier section and registry of the respective second and third connecting means of said first and second pier sections during installation of said second pier section is facilitated.

2. The multiple section pier and installation assembly of claim 1 wherein the first pair of pier support legs are adjustably mounted to said first pier section for enabling the selective raising and lowering thereof.

3. The multiple section pier and installation assembly of claim 2 wherein said first pair of pier support legs are each slidably received in elongated channel members mounted to opposite sides of said first pier section, each of said elongated channel members having clamping means associated therewith for locking a pier leg received therein in a selected position.

4. The multiple section pier and installation assembly of claim 2 wherein said first pair of pier support legs are each respectively received in a tubular support mounted to opposite sides of said first pier section, each of said tubular supports and said pair of pier support legs including a plurality of axially aligned passages, a locking pin operatively associated with each of said tubular supports, said locking pin being adapted to be received through the passages of one of said tubular supports and the pier leg received therein to selectively adjust and fix the height of said pier leg.

5. The multiple section pier and installation assembly of claim 1 wherein said first connecting means comprises a pair of hinge pins outwardly extending from each side of said first pier section, each of said pair of hinge pins being respectively adapted to be received within a pair of slots in a hinge plate which is mounted to an on-shore location or a previously installed pier section.

6. The multiple section pier and installation assembly of claim 5 wherein the respective slots in said hinge plate are arranged to resist both vertical and horizontal movement by said first pier section when the hinge pins of said first connecting means are received therein.

7. The multiple section pier and installation assembly of claim 6 wherein a first of said slots is vertically oriented and a second of said slots is angularly oriented with respect to the plane defined by the upper surface of said first pier section.

8. The multiple section pier and installation assembly of claim 1 wherein said second connecting means comprises a pair of hinge plates which are respectively mounted to opposite sides of said first pier section, each of said hinge plates including a pair of slots, and said third connecting means includes a pair of hinge pins outwardly extending from each side of said second pier section, each of said pair of hinge pins being respectively adapted to be received within the slots in each of the hinge plates of said second connecting means, said slots of said second connecting means being arranged to resist vertical and horizontal movement by said second pier section when the hinge pins of said third connecting means are received therein.

9. The multiple section pier and installation assembly of claim 8 wherein a first of said pair of slots of said second connecting means is vertically oriented and a second of said pair of slots of said second connecting means is angularly oriented with respect to the plane defined by the upper surface of said first pier section.

10. The multiple section pier and installation assembly of claim 1 wherein each of the second pair of pier support legs is adjustably mounted to said second pier section for enabling the selective raising and lowering thereof.

11. The multiple section pier and installation assembly of claim 10 wherein each of said pier support legs is received in an elongated channel member said channel member having clamping means associated therewith for locking a pier leg received therein in a selected position.

12. The multiple section pier and installation assembly of claim 11 wherein each of said second pair of pier support legs is slidably received in a tubular support which is mounted to said second pair section, said tubular support and pier support leg including a plurality of axially aligned passages, the passages of said tubular support member and said pier leg being adapted to receive a locking pin which extends therethrough for fixing the axial location of said support leg within said tubular support to selectively adjust and fix the height of said leg.

13. The multiple section pier and installation assembly of claim 1 wherein said chassis of said dolly includes a frame having a pair of fixed vertically extending dolly legs.

14. The multiple section pier and installation assembly of claim 13 wherein said fixed vertically extending dolly legs cooperate with the guide means on said dolly locator to facilitate positioning of said dolly at a selected location on said first pier section during installation of said second pier section.

15. The multiple section pier and installation assembly of claim 13 wherein a wheel is mounted to a lower portion of each of said fixed vertically extending dolly legs.

16. The multiple section pier and installation assembly of claim 15 wherein an axle extends between each of said wheels.

17. The multiple section pier and installation assembly of claim 13 wherein said pier section support member is pivotally mounted to an upper portion of each of said fixed vertically extending dolly legs.

18. The multiple section pier and installation assembly of claim 17 wherein biasing means is provided for permitting limited transverse movement of said pier section support member to facilitate registry of the respective second and third connecting means of said first and second pier sections during installation of said second pier section.

19. The multiple section pier and installation assembly of claim 18 wherein said biasing means comprises a pair of coil springs which are interposed between the outside surfaces of said pair of fixed vertically extending dolly legs and the inside surfaces of a pair of pivot arms on said pier section supporting member.

20. The multiple section pier and installation assembly of claim 13 wherein said pier section supporting member comprises a frame which includes a pair of axially extending pivot arms which are fixed to first and second transverse frame members, the upper surfaces of said pivot arms and transverse frame members being adapted to supportingly receive the upper surface of said second pier section.

21. The multiple section pier and installation assembly of claim 20 wherein said pier section hold down means includes a pair of brackets mounted to opposite sides of said second transverse frame member.

22. The multiple section pier and installation assembly of claim 21 wherein each of said brackets is provided with a vertically extending open slot for receiving one of said hinge pins of each of said pair of hinge pins of said third connecting means.

23. The multiple section pier and installation assembly of claim 22 wherein a latch having a slide bolt received therein is mounted to at least one of said brackets, said slide bolt being movable from a first latch position to a second latch position, said bolt while in said first latch position permitting travel of a second hinge pin of one of said third connecting means to a location below the axis of said bolt when said second pier section is supported on said pier section support member, and said bolt while in said second latch position being in overlying relation with respect to said second hinge pin of said one of said third connecting means when said second pier section is supported on said pier support member so as to enable said second pier section to be selectively fixedly secured to said pier section support member during pivotal movement thereof.

24. The multiple section pier and installation assembly of claim 1 wherein said dolly includes a first pair of flanges mounted to a first end of said chassis, each of said flanges having an aperture form therein for receiving an elongated dolly hold down rod, said dolly hold down rod having a handle at one end and a laterally extending hold down pin at the other end thereof, said dolly hold down rod being rotatable and slidable within said apertures, a hold down bracket mounted to the first end of said first pier section at a location below the bottom surface thereof, the lower end of said dolly hold down rod being adapted to be received within said hold down bracket to lockingly receive the hold down pin so as to resist vertical movement of said first end of said chassis during pivotal movement of said pier section support member.

25. The multiple section pier and installation assembly of claim 23 wherein a second pair of flanges are mounted to said chassis at a location between the first end thereof and the axis of rotation of said pier section support member.

26. The multiple section pier and installation assembly of claim 1 wherein said clamping means comprises a hook which is adapted to be detachably connected to the second end of said second pier section, a cable having one end connected to said hook, the other end of said cable being connected to a winch having a pulley to which a winch handle is operatively connected, said winch being mounted to a strut, one end of said strut being connected to a lower frame portion of said chassis and the other end of said strut being connected to said pier section support member.

27. The multiple section pier and installation assembly of claim 26 wherein the strut includes an upper strut arm and a lower strut arm which are pivotally connected to each other, said upper and lower strut arms being extendable into an essentially straight-line orientation to each other.

28. The multiple section pier and installation assembly of claim 27 wherein locking means is provided to secure said upper and lower strut arms in said straight-line orientation.

29. The multiple section pier and installation assembly of claim 28 wherein a pair of flanges are fixed to the lower end of said upper strut, said flanges extending in an overlying relation to the upper end of said lower strut arm when said upper and lower strut arms are in said straight-line orientation, an aperture formed in each of said flanges, said apertures of said flange plates being in axial alignment with each other, a strut arm locking pin operatively associated with said strut and adapted to be received within the apertures of said flanges when said upper and lower strut arms are in said fully extended straight-line orientation to lock said upper and lower strut arms in said straight-line orientation.

30. The multiple section pier and installation assembly of claim 1 wherein said dolly locator includes an elongated frame member having a generally flat bottom surface which extends across the full width of said first pier section.

31. The multiple section pier and installation assembly of claim 30 wherein said stop means comprises lateral extensions of said elongated frame member which are adapted to engage portions of the first pair of pier support legs which extend above the top surface of said first pier section.

32. The multiple section pier and installation assembly of claim 30 wherein said transverse alignment means comprises a pair of locating studs which extend downwardly from said elongated frame member, the distance between said locating studs being such that they overlie the sides of said first pier section in straddling relationship therewith.

33. The multiple section pier and installation assembly of claim 30 wherein said guide means comprises a pair of guide arms having a first end mounted to said elongated frame member, each of said guide arms extending from said elongated frame member in a direction which is perpendicular to the axis of said elongated frame member toward said first end of said first pier section and then angularly inwardly therefrom, said guide arms being adapted to engage a pair of fixed vertically extending dolly legs on said dolly for directing travel of said dolly into a selected position on said first pier section during installation of said second pier section.

34. The multiple section pier and installation assembly of claim 33 wherein a pair of guide plates are respectively mounted to said guide arms and extend upwardly therefrom, each of said guide plates including an open slot which is located and sized to receive an axle on said dolly.

35. A multiple section pier comprising:

a generally planar elongated first pier section having a first end and a second end oppositely disposed with respect to said first end, a pair of support legs mounted to opposite sides of said first pier section adjacent said second end thereof in generally perpendicular relation therewith, first connecting means mounted to said first end of said first pier section and adapted to be detachably connected to an on-shore location or a previously installed pier section, second pier section connecting means fixed to said second end of said first pier section, a generally planar elongated second pier section having a first end and a second end oppositely disposed with respect to said first end of said second pier section, third connecting means fixed to said first end of said second pier section and adapted to be hingedly coupled to said second connecting means, one of said second and third connecting means including a hinge pin and the other including a hinge plate having an open-ended slot formed therein for receiving said hinge pin, fourth connecting means fixed to said second end of said second pier section, and a pair of vertically extending support legs mounted to opposite sides of said second pier section adjacent said second end thereof in generally perpendicular relation therewith.

36. The multiple section pier of claim 35 wherein the first pair of pier support legs are adjustably mounted to said first pier section for enabling the selective raising and lowering thereof.

37. The multiple section pier of claim 36 wherein said first pair of pier support legs are each slidably received in elongated channel members mounted to opposite sides of said first pier section, each of said elongated channel members having clamping means associated therewith for locking a pier leg received therein in a selected position.

38. The multiple section pier and installation assembly of claim 36 wherein said first pair of pier support legs are each respectively received in a tubular support mounted to opposite sides of said first pier section, each of said tubular supports and said pair of pier support legs including a plurality of axially aligned passages, a locking pin operatively associated with each of said tubular supports, said locking pin being adapted to be received through the passages of one of said tubular supports and the pier leg received therein to selectively adjust and fix the height of said pier leg.

39. The multiple section pier and installation assembly of claim 35 wherein said first connecting means comprises a pair of hinge pins outwardly extending from each side of said first pier section, each of said pair of hinge pins being respectively adapted to be received within a pair of slots in a hinge plate which is mounted to an on-shore location or a previously installed pier section.

40. The multiple section pier and installation assembly of claim 39 wherein the respective slots in said hinge plate are arranged to resist both vertical and horizontal movement by said first pier section when the hinge pins of said first connecting means are received therein.

41. The multiple section pier and installation assembly of claim 40 wherein a first of said slots is vertically oriented and a second of said slots is angularly oriented with respect to the plane defined by the upper surface of said first pier section.

42. The multiple section pier and installation assembly of claim 35 wherein said second connecting means comprises a pair of hinge plates which are respectively mounted to opposite sides of said first pier section, each of said hinge plates including a pair of slots, and said third connecting means includes a pair of hinge pins outwardly extending from each side of said second pier section, each of said pair of hinge pins being respectively adapted to be received within the slots in each of the hinge plates of said second connecting means, said slots of said second connecting means being arranged to resist vertical and horizontal movement by said second pier section when the hinge pins of said third connecting means are received therein.

43. The multiple section pier and installation assembly of claim 42 wherein a first of said pair of slots of said second connecting means is vertically oriented and a second of said pair of slots of said second connecting means is angularly oriented with respect to the plane defined by the upper surface of said first pier section.

44. The multiple section pier and installation assembly of claim 35 wherein each of the second pair of pier support legs is adjustably mounted to said second pier section for enabling the selective raising an lowering thereof.

45. The multiple section pier and installation assembly of claim 44 wherein each of said pier support legs is received in an elongated channel member said channel member having clamping means associated therewith for locking a pier leg received therein in a selected position.

46. The multiple section pier and installation assembly of claim 45 wherein each of said second pair of pier support legs is slidably received in a tubular support which is mounted to said second pair section, said tubular support and pier support leg including a plurality of axially aligned passages, the passages of said tubular support member and said pier leg being adapted to receive a locking pin which extends therethrough for fixing the axial location of said support leg within said tubular support to selectively adjust and fix the height of said leg.

47. In a multiple section pier and installation assembly which includes a generally planar elongated first pier section having a first end and a second end oppositely disposed with respect to said first end, a pair of support legs mounted to opposite sides of said first pier section adjacent said second end thereof in generally perpendicular relation therewith, first connecting means mounted to said first end of said first pier section and adapted to be detachably connected to an on-shore location or a previously installed pier section, second pier section connecting means mounted to said second end of said first pier section, a generally planar elongated second pier section having a first end and a second end oppositely disposed with respect to said first end of said second pier section, third connecting means mounted to said first end of said second pier section and adapted to be hingedly coupled to said second connecting means, fourth connecting means mounted to said second end of said second pier section, a pair of vertically extending support legs mounted to opposite sides of said second pier section adjacent said second end thereof in generally perpendicular relation therewith and a dolly for assembling said first and second pier sections, the improvement wherein said dolly comprises a chassis and a pier section support member, said second pier section being supported on said pier section support member, pier section hold down means mounted at one end of said pier section support member, clamping means adjacent a second end of said support member, said support member being pivotally mounted to said dolly chassis for rotation about an axis which is interposed between the first and second ends of said support member, said pier section hold down means being releasably secured to said third connecting means, and said clamping means being releasably secured to said second end of said second pier section.

48. The improvement of claim 47 wherein said chassis of said dolly includes a frame having a pair of fixed vertically extending dolly legs.

49. The improvement of claim 48 wherein said fixed vertically extending dolly legs cooperate with the guide means on a dolly locator to facilitate positioning of said dolly at a selected location on said first pier section during installation of said second pier section.

50. The improvement of claim 49 wherein a wheel is mounted to a lower portion of each of said fixed vertically extending dolly legs.

51. The improvement of claim 50 wherein an axle extends between each of said wheels.

52. The improvement of claim 51 wherein said pier section support member is pivotally mounted to an upper portion of each of said fixed vertically extending dolly legs.

53. The improvement of claim 52 wherein biasing means is provided for permitting limited transverse movement of said pier section support member to facilitate registry of the respective second and third connecting means of said first and second pier sections during installation of said second pier section.

54. The improvement of claim 53 wherein said biasing means comprises a pair of coil springs which are interposed between the outside surfaces of said pair of fixed vertically extending dolly legs and the inside surfaces of a pair of pivot arms on said pier section supporting member.

55. The improvement of claim 54 wherein said pier section supporting member comprises a frame which includes a pair of axially extending pivot arms which are fixed to first and second transverse frame members, the upper surfaces of said pivot arms and transverse frame members being adapted to supportingly receive the upper surface of said second pier section.

56. The improvement of claim 55 wherein said pier section hold down means includes a pair of brackets mounted to opposite sides of said second transverse frame member.

57. The improvement of claim 56 wherein each of said brackets is provided with a vertically extending open slot for receiving one of said hinge pins of each of said pair of hinge pins of said third connecting means.

58. The improvement of claim 57 wherein a latch having a slide bolt received therein is mounted to at least one of said brackets, said slide bolt being movable from a first latch position to a second latch position, said bolt while in said first latch position permitting travel of a second hinge pin of one of said third connecting means to a location below the axis of said bolt when said second pier section is supported on said pier section support member, and said bolt while in said second latch position being in overlying relation with respect to said second hinge pin of said one of said third connecting means when said second pier section is supported on said pier support member so as to enable said second pier section to be selectively fixedly secured to said pier section support member during pivotal movement thereof.

59. The improvement of claim 47 wherein said dolly includes a first pair of flanges mounted to a first end of said chassis, each of said flanges having an aperture form therein for receiving an elongated dolly hold down rod, said dolly hold down rod having a handle at one end and a laterally extending hold down pin at the other end thereof, said dolly hold down rod being rotatable and slidable within said apertures, a hold down bracket mounted to the first end of said first pier section at a location below the bottom surface thereof, the lower end of said dolly hold down rod being adapted to be received within said hold down bracket to lockingly receive the hold down pin so as to resist vertical movement of said first end of said chassis during pivotal movement of said pier section support member.

60. The improvement of claim 58 wherein a second pair of flanges are mounted to said chassis at a location between the first end thereof and the axis of rotation of said pier section support member.

61. The improvement claim 47 wherein said clamping means comprises a hook which is adapted to be detachably connected to the second end of said second pier section, a cable having one end connected to said hook, the other end of said cable being connected to a winch having a pulley to which a winch handle is operatively connected, said winch being mounted to a strut, one end of said strut being connected to a lower frame portion of said chassis and the other end of said strut being connected to said pier section support member.

62. The improvement of claim 61 wherein the strut includes an upper strut arm and a lower strut arm which are pivotally connected to each other, said upper and lower strut arms being extendable into an essentially straight-line orientation to each other.

63. The improvement of claim 62 wherein locking means is provided to secure said upper and lower strut arms in said straight-line orientation.

64. The improvement of claim 63 wherein a pair of flanges are fixed to the lower end of said upper strut, said flanges extending in an overlying relation to the upper end of said lower strut arm when said upper and lower strut arms are in said straight-line orientation, an aperture formed in each of said flanges, said apertures of said flange plates being in axial alignment with each other, a strut arm locking pin operatively associated with said strut and adapted to be received within the apertures of said flanges when said upper and lower strut arms are in said fully extended straight-line orientation to lock said upper and lower strut arms in said straight-line orientation.

65. In a multiple section pier and installation assembly which includes a generally planar elongated first pier section having a first end and a second end oppositely disposed with respect to said first end, a pair of support legs mounted to opposite sides of said first pier section adjacent said second end thereof in generally perpendicular relation therewith, first connecting means mounted to said first end of said first pier section and adapted to be detachably connected to an on-shore location or a previously installed pier section, second pier section connecting means mounted to said second end of said first pier section, a generally planar elongated second pier section having a first end and a second end oppositely disposed with respect to said first end of said second pier section, third connecting means mounted to said first end of said second pier section and adapted to be hingedly coupled to said second connecting means, fourth connecting means mounted to said second end of said second pier section, a pair of vertically extending support legs mounted to opposite sides of said second pier section adjacent said second end thereof in generally perpendicular relation therewith, a dolly and a dolly locator, the improvement wherein dolly locator is adapted to be positioned on said first pier section and comprises means for limiting travel of said dolly locator in the direction of said second end of said first pier section to a selected position adjacent said second end of said first pier section, transverse alignment means for positioning said dolly locator at a selected transverse location on said first pier section, and guide means cooperative with said dolly for receiving and positioning said dolly at a selected location on said first pier section during installation of said second pier section.

66. The improvement of claim 65 wherein said dolly locator includes an elongated frame member having a generally flat bottom surface which extends across the full width of said first pier section.

67. The improvement of claim 66 wherein said stop means comprises lateral extensions of said elongated frame member which are adapted to engage portions of the first pair of pier support legs which extend above the top surface of said first pier section.

68. The improvement of claim 67 wherein said transverse alignment means comprises a pair of locating studs which extend downwardly from said elongated frame member, the distance between said locating studs being such that they overlie the sides of said first pier section in straddling relationship therewith.

69. The improvement of claim 66 wherein said dolly locator includes a pair of guide arms having a first end mounted to said elongated frame member, each of said guide arms extending from said elongated frame member in a direction which is perpendicular to the axis of said elongated frame member toward said first end of said first pier section and then angularly inwardly therefrom, said guide arms being adapted to engage a pair of fixed vertically extending dolly legs on said dolly for directing travel of said dolly into a selected position on said first pier section during installation of said second pier section.

70. The improvement of claim 69 wherein a pair of guide plates are respectively mounted to said guide arms and extend upwardly therefrom, each of said guide plates including an open slot which is located and sized to receive an axle on said dolly.

* * * * *